US010669723B2

(12) United States Patent
Pervan et al.

(10) Patent No.: US 10,669,723 B2
(45) **Date of Patent: *Jun. 2, 2020**

(54) MECHANICAL LOCKING OF FLOOR PANELS WITH A FLEXIBLE BRISTLE TONGUE

(71) Applicant: VALINGE INNOVATION AB, Viken (SE)

(72) Inventors: Darko Pervan, Viken (SE); Agne Palsson, Hasslarp (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 15/172,926

(22) Filed: Jun. 3, 2016

(65) Prior Publication Data

US 2016/0281368 A1 Sep. 29, 2016

Related U.S. Application Data

(63) Continuation of application No. 14/463,972, filed on Aug. 20, 2014, now Pat. No. 9,382,716, which is a (Continued)

(30) Foreign Application Priority Data

Jul. 11, 2006 (SE) ..... 0601550

(51) Int. Cl.
*E04F 15/14* (2006.01)
*E04F 15/02* (2006.01)
(Continued)

(52) U.S. Cl.
CPC ..... *E04F 15/02038* (2013.01); *E04B 5/00* (2013.01); *E04F 15/02* (2013.01);
(Continued)

(58) Field of Classification Search
CPC ..... E04F 15/02; E04F 15/02005; E04F 15/02038; E04F 15/10; E04F 15/107;
(Continued)

(56) References Cited

U.S. PATENT DOCUMENTS 87,853 A 3/1869 Kappes
108,068 A 10/1870 Utley
(Continued)

FOREIGN PATENT DOCUMENTS

CA 2456513 A1 2/2003
DE 138 992 C 7/1901
(Continued)

OTHER PUBLICATIONS

U.S. Appl. No. 15/603,913, Darko Pervan, filed May 24, 2017 (Cited herein as US Patent Application Publication No. 2017/0254096 A1 of Sep. 7, 2017).
(Continued)

*Primary Examiner* — William V Gilbert
(74) *Attorney, Agent, or Firm* — Buchanan Ingersoll & Rooney P.C.

(57) ABSTRACT

Floor panels which are provided with a mechanical locking system including a displaceable tongue in a displacement groove. The tongue is moulded and provided with bendable protrusions. A building panel having an edge portion provided with a groove, in which a tongue formed as a separate part is received, wherein the tongue includes at least two bow shaped protrusions at a first long edge of the tongue, and wherein the protrusions are arranged bendable in the groove.

15 Claims, 18 Drawing Sheets

Related U.S. Application Data continuation of application No. 13/728,121, filed on Dec. 27, 2012, now Pat. No. 8,844,236, which is a continuation of application No. 13/195,297, filed on Aug. 1, 2011, now Pat. No. 8,359,805, which is a continuation of application No. 12/788,384, filed on May 27, 2010, now Pat. No. 8,033,074, which is a continuation of application No. 11/775,885, filed on Jul. 11, 2007, now Pat. No. 7,908,815, which is a continuation-in-part of application No. PCT/SE2006/001218, filed on Oct. 27, 2006.

(60) Provisional application No. 60/806,975, filed on Jul. 11, 2006.

(51) Int. Cl.

| | |
|---|---|
| ***E04B 5/00*** | (2006.01) |
| ***E04F 15/04*** | (2006.01) |
| ***E04F 15/08*** | (2006.01) |
| ***E04F 15/10*** | (2006.01) |
| ***E04F 15/18*** | (2006.01) |

(52) U.S. Cl.

CPC ..... *E04F 15/04* (2013.01); *E04F 15/08* (2013.01); *E04F 15/10* (2013.01); *E04F 15/107* (2013.01); *E04F 15/18* (2013.01); *E04F 2201/0115* (2013.01); *E04F 2201/0138* (2013.01); *E04F 2201/0153* (2013.01); *E04F 2201/0523* (2013.01); *E04F 2201/0547* (2013.01); *Y10T 428/167* (2015.01)

(58) Field of Classification Search

CPC ..... E04F 2201/03; E04F 2201/04; E04F 2201/041; E04F 2201/042; E04F 2201/043; E04F 2201/044; E04F 2201/045; E04F 2201/046

See application file for complete search history.

(56) References Cited

U.S. PATENT DOCUMENTS

| | | | | |
|---|---|---|---|---|
| 124,228 | A | | 3/1872 | Stuart |
| 213,740 | A | | 4/1879 | Conner |
| 274,354 | A | | 3/1883 | McCarthy et al. |
| 316,176 | A | | 4/1885 | Ransom |
| 634,581 | A | | 10/1899 | Miller |
| 861,911 | A | | 7/1907 | Stewart |
| 1,194,636 | A | | 8/1916 | Joy |
| 1,723,306 | A | | 8/1929 | Sipe |
| 1,743,492 | A | | 1/1930 | Sipe |
| 1,809,393 | A | | 6/1931 | Rockwell |
| 1,902,716 | A | | 3/1933 | Newton |
| 2,026,511 | A | | 12/1935 | Storm |
| 2,027,292 | A | | 1/1936 | Rockwell |
| 2,110,728 | A | | 3/1938 | Hoggatt |
| 2,142,305 | A | | 1/1939 | Davis |
| 2,204,675 | A | | 6/1940 | Grunert |
| 2,266,464 | A | | 12/1941 | Kraft |
| 2,277,758 | A | | 3/1942 | Hawkins |
| 2,430,200 | A | | 11/1947 | Wilson |
| 2,596,280 | A | | 5/1952 | Nystrom |
| 2,732,706 | A | | 1/1956 | Friedman |
| 2,740,167 | A | | 4/1956 | Rowley |
| 2,858,584 | A | | 11/1958 | Gaines |
| 2,863,185 | A | | 12/1958 | Riedi |
| 2,865,058 | A | | 12/1958 | Andersson |
| 2,889,016 | A | | 6/1959 | Warren |
| 3,023,681 | A | | 3/1962 | Worson |
| 3,077,703 | A | | 2/1963 | Bergstrom |
| 3,099,110 | A | | 7/1963 | Spaight |
| 3,147,522 | A | | 9/1964 | Schumm |
| 3,172,237 | A | | 3/1965 | Bradley |
| 3,187,612 | A | | 6/1965 | Hervey |
| 3,271,787 | A | | 9/1966 | Clary |
| 3,276,797 | A | * | 10/1966 | Humes, Jr. ..... E04B 1/615 411/458 |
| 3,308,588 | A | | 3/1967 | Von Wedel |
| 3,325,585 | A | | 6/1967 | Brenneman |
| 3,331,180 | A | | 7/1967 | Vissing et al. |
| 3,378,958 | A | | 4/1968 | Parks et al. |
| 3,396,640 | A | | 8/1968 | Fujihara |
| 3,512,324 | A | | 5/1970 | Reed |
| 3,517,927 | A | | 6/1970 | Kennel |
| 3,526,071 | A | | 9/1970 | Watanabe |
| 3,535,884 | A | | 10/1970 | Glaros |
| 3,572,224 | A | | 3/1971 | Perry |
| 3,579,941 | A | | 5/1971 | Tibbals |
| 3,626,822 | A | | 12/1971 | Koster |
| 3,640,191 | A | | 2/1972 | Hendrich |
| 3,694,983 | A | | 10/1972 | Couquet |
| 3,720,027 | A | | 3/1973 | Christensen |
| 3,722,379 | A | | 3/1973 | Koester |
| 3,731,445 | A | | 5/1973 | Hoffmann et al. |
| 3,742,669 | A | | 7/1973 | Mansfeld |
| 3,760,547 | A | | 9/1973 | Brenneman |
| 3,760,548 | A | | 9/1973 | Sauer et al. |
| 3,764,767 | A | | 10/1973 | Randolph |
| 3,778,954 | A | | 12/1973 | Meserole |
| 3,849,235 | A | | 11/1974 | Gwynne |
| 3,919,820 | A | | 11/1975 | Green |
| 3,950,915 | A | | 4/1976 | Cole |
| 3,994,609 | A | | 11/1976 | Puccio |
| 4,007,767 | A | | 2/1977 | Colledge |
| 4,007,994 | A | | 2/1977 | Brown |
| 4,030,852 | A | | 6/1977 | Hein |
| 4,037,377 | A | | 7/1977 | Howell et al. |
| 4,041,665 | A | | 8/1977 | de Munck |
| 4,064,571 | A | | 12/1977 | Phipps |
| 4,080,086 | A | | 3/1978 | Watson |
| 4,082,129 | A | | 4/1978 | Morelock |
| 4,100,710 | A | | 7/1978 | Kowallik |
| 4,104,840 | A | | 8/1978 | Heintz et al. |
| 4,107,892 | A | | 8/1978 | Bellem |
| 4,113,399 | A | | 9/1978 | Hansen, Sr. et al. |
| 4,154,041 | A | | 5/1979 | Namy |
| 4,169,688 | A | | 10/1979 | Toshio |
| RE30,154 | E | | 11/1979 | Jarvis |
| 4,196,554 | A | | 4/1980 | Anderson |
| 4,227,430 | A | | 10/1980 | Jansson et al. |
| 4,299,070 | A | | 11/1981 | Oltmanns |
| 4,304,083 | A | | 12/1981 | Anderson |
| 4,426,820 | A | | 1/1984 | Terbrack |
| 4,447,172 | A | | 5/1984 | Galbreath |
| 4,512,131 | A | | 4/1985 | Laramore |
| 4,599,841 | A | | 7/1986 | Haid |
| 4,622,784 | A | | 11/1986 | Black |
| 4,648,165 | A | | 3/1987 | Whitehorne |
| 4,819,932 | A | | 4/1989 | Trotter, Jr. |
| 4,948,716 | A | | 8/1990 | Mihayashi et al. |
| 4,998,395 | A | | 3/1991 | Bezner |
| 5,007,222 | A | | 4/1991 | Raymond |
| 5,026,112 | A | | 6/1991 | Rice |
| 5,071,282 | A | | 12/1991 | Brown |
| 5,135,597 | A | | 8/1992 | Barker |
| 5,148,850 | A | | 9/1992 | Urbanick |
| 5,173,012 | A | | 12/1992 | Ortwein et al. |
| 5,182,892 | A | | 2/1993 | Chase |
| 5,247,773 | A | | 9/1993 | Weir |
| 5,272,850 | A | | 12/1993 | Mysliwiec et al. |
| 5,274,979 | A | | 1/1994 | Tsai |
| 5,281,055 | A | | 1/1994 | Neitzke et al. |
| 5,295,341 | A | | 3/1994 | Kajiwara |
| 5,344,700 | A | | 9/1994 | McGath et al. |
| 5,348,778 | A | | 9/1994 | Knipp et al. |
| 5,373,674 | A | | 12/1994 | Winter, IV |
| 5,465,546 | A | | 11/1995 | Buse |
| 5,485,702 | A | | 1/1996 | Sholton |
| 5,502,939 | A | | 4/1996 | Zadok et al. |
| 5,548,937 | A | | 8/1996 | Shimonohara |
| 5,577,357 | A | | 11/1996 | Civelli |
| 5,587,218 | A | | 12/1996 | Betz |

(56) References Cited

U.S. PATENT DOCUMENTS 5,598,682 A 2/1997 Haughian
5,616,389 A 4/1997 Blatz
5,618,602 A 4/1997 Nelson
5,634,309 A 6/1997 Polen
5,658,086 A 8/1997 Brokaw et al.
5,694,730 A 12/1997 Del Rincon et al.
5,755,068 A 5/1998 Ormiston
5,860,267 A 1/1999 Pervan
5,899,038 A 5/1999 Stroppiana
5,910,084 A 6/1999 Koike
5,950,389 A 9/1999 Porter
5,970,675 A 10/1999 Schray
6,006,486 A 12/1999 Moriau
6,029,416 A 2/2000 Andersson
6,052,960 A 4/2000 Yonemura
6,065,262 A 5/2000 Motta
6,098,354 A 8/2000 Skandis
6,134,854 A 10/2000 Stanchfield
6,145,261 A 11/2000 Godfrey et al.
6,164,618 A 12/2000 Yonemura
6,173,548 B1 1/2001 Hamar et al.
6,182,410 B1 2/2001 Pervan
6,203,653 B1 3/2001 Seidner
6,210,512 B1 4/2001 Jones
6,254,301 B1 7/2001 Hatch
6,295,779 B1 10/2001 Canfield
6,314,701 B1 11/2001 Meyerson
6,324,809 B1 12/2001 Nelson
6,332,733 B1 12/2001 Hamberger
6,339,908 B1 1/2002 Chuang
6,345,481 B1 2/2002 Nelson
6,358,352 B1 3/2002 Schmidt
6,363,677 B1 4/2002 Chen et al.
6,385,936 B1 5/2002 Schneider
6,418,683 B1 7/2002 Martensson et al.
6,446,413 B1 9/2002 Gruber
6,449,918 B1 9/2002 Nelson
6,450,235 B1 9/2002 Lee
6,490,836 B1 12/2002 Moriau et al.
6,505,452 B1 1/2003 Hannig
6,546,691 B2 4/2003 Leopolder
6,553,724 B1 4/2003 Bigler
6,576,079 B1 6/2003 Kai
6,584,747 B2 7/2003 Kettler et al.
6,588,166 B2 * 7/2003 Martensson ..... E04B 1/6129 403/364
6,591,568 B1 7/2003 Pålsson
6,601,359 B2 8/2003 Olofsson
6,617,009 B1 9/2003 Chen et al.
6,647,689 B2 11/2003 Pletzer et al.
6,647,690 B1 11/2003 Martensson
6,651,400 B1 11/2003 Murphy
6,670,019 B2 12/2003 Andersson
6,672,030 B2 1/2004 Schulte
6,681,820 B2 1/2004 Olofsson
6,682,254 B1 1/2004 Olofsson et al.
6,684,592 B2 2/2004 Martin
6,685,391 B1 2/2004 Gideon
6,729,091 B1 5/2004 Martensson
6,763,643 B1 7/2004 Martensson
6,766,622 B1 7/2004 Thiers
6,769,219 B2 8/2004 Schwitte et al.
6,769,835 B2 8/2004 Stridsman
6,802,166 B1 10/2004 Durnberger
6,804,926 B1 10/2004 Eisermann
6,808,777 B2 10/2004 Andersson
6,854,235 B2 2/2005 Martensson
6,862,857 B2 3/2005 Tychsen
6,865,855 B2 3/2005 Knauseder
6,874,291 B1 4/2005 Weber
6,880,307 B2 4/2005 Schwitte
6,948,716 B2 9/2005 Drouin
7,021,019 B2 4/2006 Knauseder
7,040,068 B2 5/2006 Moriau et al.
7,051,486 B2 5/2006 Pervan
7,108,031 B1 9/2006 Secrest
7,121,058 B2 10/2006 Pålsson
7,152,383 B1 12/2006 Wilkinson et al.
7,156,383 B1 1/2007 Jacobs
7,188,456 B2 3/2007 Knauseder
7,219,392 B2 5/2007 Mullet et al.
7,251,916 B2 8/2007 Konzelmann et al.
7,257,926 B1 8/2007 Kirby
7,337,588 B1 3/2008 Moebus
7,377,081 B2 5/2008 Ruhdorfer
7,380,383 B2 6/2008 Olofsson et al.
7,441,384 B2 10/2008 Miller et al.
7,451,578 B2 11/2008 Hannig
7,454,875 B2 11/2008 Pervan et al.
7,516,588 B2 4/2009 Pervan
7,517,427 B2 4/2009 Sjoberg et al.
7,520,092 B2 4/2009 Showers et al.
7,533,500 B2 5/2009 Morton et al.
7,556,849 B2 7/2009 Thompson et al.
7,568,322 B2 8/2009 Pervan
7,584,583 B2 9/2009 Bergelin et al.
7,591,116 B2 9/2009 Thiers et al.
7,614,197 B2 11/2009 Nelson
7,617,651 B2 11/2009 Grafenauer
7,621,092 B2 11/2009 Groeke et al.
7,621,094 B2 11/2009 Moriau et al.
7,634,884 B2 12/2009 Pervan
7,637,068 B2 12/2009 Pervan
7,644,553 B2 1/2010 Knauseder
7,654,055 B2 2/2010 Ricker
7,677,005 B2 3/2010 Pervan
7,716,889 B2 5/2010 Pervan
7,721,503 B2 5/2010 Pervan et al.
7,748,176 B2 7/2010 Harding et al.
7,757,452 B2 7/2010 Pervan
7,802,411 B2 9/2010 Pervan
7,806,624 B2 10/2010 McLean et al.
7,827,749 B2 11/2010 Groeke et al.
7,841,144 B2 11/2010 Pervan et al.
7,841,145 B2 11/2010 Pervan et al.
7,841,150 B2 11/2010 Pervan
7,849,642 B2 12/2010 Forster et al.
7,856,789 B2 12/2010 Eisermann
7,861,482 B2 1/2011 Pervan et al.
7,866,110 B2 1/2011 Pervan
7,900,416 B1 3/2011 Yokubison et al.
7,908,815 B2 3/2011 Pervan et al.
7,908,816 B2 3/2011 Grafenauer
7,913,471 B2 3/2011 Pervan
7,930,862 B2 4/2011 Bergelin et al.
7,954,295 B2 6/2011 Pervan
7,964,133 B2 6/2011 Cappelle
7,980,039 B2 7/2011 Groeke
7,980,041 B2 7/2011 Pervan
8,001,741 B2 8/2011 Duernberger
8,006,458 B1 8/2011 Olofsson et al.
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,234,830 B2 8/2012 Pervan et al.
8,245,478 B2 8/2012 Bergelin
8,302,367 B2 11/2012 Schulte
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,375,673 B2 2/2013 Evjen
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,511,031 B2 8/2013 Bergelin et al.
8,528,289 B2 9/2013 Pervan et al.
8,544,230 B2 10/2013 Pervan

(56) References Cited

U.S. PATENT DOCUMENTS

| | | | |
|---|---|---|---|
| 8,544,233 | B2 | 10/2013 | Pålsson |
| 8,544,234 | B2 | 10/2013 | Pervan et al. |
| 8,572,922 | B2 | 11/2013 | Pervan |
| 8,578,675 | B2 | 11/2013 | Palsson et al. |
| 8,596,013 | B2 | 12/2013 | Boo |
| 8,627,862 | B2 | 1/2014 | Pervan et al. |
| 8,640,424 | B2 | 2/2014 | Pervan et al. |
| 8,650,826 | B2 | 2/2014 | Pervan et al. |
| 8,677,714 | B2 | 3/2014 | Pervan |
| 8,689,512 | B2 | 4/2014 | Pervan |
| 8,707,650 | B2 | 4/2014 | Pervan |
| 8,713,886 | B2 | 5/2014 | Boo et al. |
| 8,733,065 | B2 | 5/2014 | Pervan |
| 8,733,410 | B2 | 5/2014 | Pervan |
| 8,763,341 | B2 | 7/2014 | Pervan |
| 8,769,905 | B2 | 7/2014 | Pervan |
| 8,776,473 | B2 | 7/2014 | Pervan et al. |
| 8,806,832 | B2 | 8/2014 | Kell |
| 8,844,236 | B2 | 9/2014 | Pervan et al. |
| 8,857,126 | B2 | 10/2014 | Pervan et al. |
| 8,869,485 | B2 | 10/2014 | Pervan |
| 8,898,988 | B2 | 12/2014 | Pervan |
| 8,925,274 | B2 | 1/2015 | Pervan et al. |
| 8,959,866 | B2 | 2/2015 | Pervan |
| 8,973,331 | B2 | 3/2015 | Boo |
| 8,991,055 | B2 | 3/2015 | Cappelle |
| 9,027,306 | B2 | 5/2015 | Pervan |
| 9,051,738 | B2 | 6/2015 | Pervan et al. |
| 9,068,360 | B2 | 6/2015 | Pervan |
| 9,091,077 | B2 | 7/2015 | Boo |
| 9,103,126 | B2 | 8/2015 | Kell |
| 9,151,062 | B2 | 10/2015 | Cappelle et al. |
| 9,194,134 | B2 | 11/2015 | Nygren et al. |
| 9,212,492 | B2 | 12/2015 | Pervan et al. |
| 9,216,541 | B2 | 12/2015 | Boo et al. |
| 9,238,917 | B2 | 1/2016 | Pervan et al. |
| 9,284,737 | B2 | 3/2016 | Pervan et al. |
| 9,309,679 | B2 | 4/2016 | Pervan et al. |
| 9,316,002 | B2 | 4/2016 | Boo |
| 9,340,974 | B2 | 5/2016 | Pervan et al. |
| 9,347,469 | B2 | 5/2016 | Pervan |
| 9,359,774 | B2 | 6/2016 | Pervan |
| 9,366,036 | B2 | 6/2016 | Pervan |
| 9,376,821 | B2 | 6/2016 | Pervan et al. |
| 9,382,716 | B2 | 7/2016 | Pervan et al. |
| 9,388,584 | B2 | 7/2016 | Pervan et al. |
| 9,428,919 | B2 | 8/2016 | Pervan et al. |
| 9,453,347 | B2 | 9/2016 | Pervan et al. |
| 9,458,634 | B2 | 10/2016 | Derelov |
| 9,482,012 | B2 | 11/2016 | Nygren et al. |
| 9,540,826 | B2 | 1/2017 | Pervan et al. |
| 9,663,940 | B2 | 5/2017 | Boo |
| 9,725,912 | B2 | 8/2017 | Pervan |
| 9,771,723 | B2 | 9/2017 | Pervan |
| 9,777,487 | B2 | 10/2017 | Pervan et al. |
| 9,803,374 | B2 | 10/2017 | Pervan |
| 9,803,375 | B2 | 10/2017 | Pervan |
| 9,856,656 | B2 | 1/2018 | Pervan |
| 9,874,027 | B2 | 1/2018 | Pervan |
| 9,945,130 | B2 | 4/2018 | Nygren et al. |
| 9,951,526 | B2 | 4/2018 | Boo et al. |
| 10,000,935 | B2 | 6/2018 | Kell |
| 10,006,210 | B2 | 6/2018 | Pervan et al. |
| 10,017,948 | B2 | 7/2018 | Boo |
| 10,113,319 | B2 | 10/2018 | Pervan |
| 10,125,488 | B2 | 11/2018 | Boo |
| 10,138,636 | B2 | 11/2018 | Pervan |
| 10,161,139 | B2 | 12/2018 | Pervan |
| 10,180,005 | B2 | 1/2019 | Pervan et al. |
| 10,214,915 | B2 | 2/2019 | Pervan et al. |
| 10,214,917 | B2 | 2/2019 | Pervan et al. |
| 10,240,348 | B2 | 3/2019 | Pervan et al. |
| 10,240,349 | B2 | 3/2019 | Pervan et al. |
| 10,246,883 | B2 | 4/2019 | Derelöv |
| 10,352,049 | B2 | 7/2019 | Boo |
| 10,358,830 | B2 | 7/2019 | Pervan |
| 10,378,217 | B2 | 8/2019 | Pervan |
| 10,458,125 | B2 | 10/2019 | Pervan |
| 10,480,196 | B2 | 11/2019 | Boo |
| 10,519,676 | B2 | 12/2019 | Pervan |
| 10,526,792 | B2 | 1/2020 | Pervan et al. |
| 10,538,922 | B2 | 1/2020 | Pervan |
| 10,570,625 | B2 | 2/2020 | Pervan |
| 2001/0024707 | A1 | 9/2001 | Andersson et al. |
| 2001/0034991 | A1 | 11/2001 | Martensson |
| 2001/0045150 | A1 | 11/2001 | Owens |
| 2002/0014047 | A1 | 2/2002 | Thiers |
| 2002/0031646 | A1 | 3/2002 | Chen et al. |
| 2002/0069611 | A1 | 6/2002 | Leopolder |
| 2002/0092263 | A1 | 7/2002 | Schulte |
| 2002/0095894 | A1 | 7/2002 | Pervan |
| 2002/0108343 | A1 | 8/2002 | Knauseder |
| 2002/0170258 | A1 | 11/2002 | Schwitte et al. |
| 2002/0170259 | A1 | 11/2002 | Ferris |
| 2002/0178674 | A1 | 12/2002 | Pervan |
| 2002/0178680 | A1 | 12/2002 | Martensson |
| 2002/0189190 | A1 | 12/2002 | Charmat et al. |
| 2002/0189747 | A1 | 12/2002 | Steinwender |
| 2002/0194807 | A1 | 12/2002 | Nelson et al. |
| 2003/0009971 | A1 | 1/2003 | Palmberg |
| 2003/0024199 | A1 | 2/2003 | Pervan et al. |
| 2003/0037504 | A1 | 2/2003 | Schwitte et al. |
| 2003/0066588 | A1 | 4/2003 | Pålsson |
| 2003/0084636 | A1 | 5/2003 | Pervan |
| 2003/0094230 | A1 | 5/2003 | Sjoberg |
| 2003/0101674 | A1 | 6/2003 | Pervan |
| 2003/0101681 | A1 | 6/2003 | Tychsen |
| 2003/0145549 | A1 | 8/2003 | Palsson et al. |
| 2003/0180091 | A1 | 9/2003 | Stridsman |
| 2003/0188504 | A1 | 10/2003 | Ralf |
| 2003/0196405 | A1 | 10/2003 | Pervan |
| 2004/0016196 | A1 | 1/2004 | Pervan |
| 2004/0031225 | A1 | 2/2004 | Fowler |
| 2004/0031227 | A1 | 2/2004 | Knauseder |
| 2004/0049999 | A1 | 3/2004 | Krieger |
| 2004/0060255 | A1 | 4/2004 | Knauseder |
| 2004/0068954 | A1 | 4/2004 | Martensson |
| 2004/0123548 | A1 | 7/2004 | Gimpel et al. |
| 2004/0128934 | A1 | 7/2004 | Hecht |
| 2004/0137180 | A1 | 7/2004 | Sjoberg et al. |
| 2004/0139676 | A1 | 7/2004 | Knauseder |
| 2004/0139678 | A1 | 7/2004 | Pervan |
| 2004/0159066 | A1 | 8/2004 | Thiers et al. |
| 2004/0168392 | A1 | 9/2004 | Konzelmann et al. |
| 2004/0177584 | A1 | 9/2004 | Pervan |
| 2004/0182033 | A1 | 9/2004 | Wernersson |
| 2004/0182036 | A1 | 9/2004 | Sjoberg et al. |
| 2004/0200175 | A1 | 10/2004 | Weber |
| 2004/0211143 | A1 | 10/2004 | Hanning |
| 2004/0238001 | A1 | 12/2004 | Risden |
| 2004/0244325 | A1 | 12/2004 | Nelson |
| 2004/0250492 | A1 | 12/2004 | Becker |
| 2004/0261348 | A1 | 12/2004 | Vulin |
| 2005/0003132 | A1 | 1/2005 | Blix et al. |
| 2005/0028474 | A1 | 2/2005 | Kim |
| 2005/0050827 | A1 | 3/2005 | Schitter |
| 2005/0160694 | A1 | 7/2005 | Pervan |
| 2005/0166514 | A1 | 8/2005 | Pervan |
| 2005/0205161 | A1 | 9/2005 | Lewark |
| 2005/0210810 | A1 | 9/2005 | Pervan |
| 2005/0235593 | A1 | 10/2005 | Hecht |
| 2005/0252130 | A1 | 11/2005 | Martensson |
| 2005/0252167 | A1 | 11/2005 | Van Horne, Jr. |
| 2005/0268570 | A2 | 12/2005 | Pervan |
| 2006/0053724 | A1 | 3/2006 | Braun et al. |
| 2006/0070333 | A1 | 4/2006 | Pervan |
| 2006/0101769 | A1 | 5/2006 | Pervan |
| 2006/0156670 | A1 | 7/2006 | Knauseder |
| 2006/0174577 | A1 | 8/2006 | O'Neil |
| 2006/0179754 | A1 | 8/2006 | Yang |
| 2006/0185287 | A1 | 8/2006 | Glazer et al. |
| 2006/0236642 | A1 | 10/2006 | Pervan |
| 2006/0260254 | A1 | 11/2006 | Pervan et al. |
| 2006/0272262 | A1 | 12/2006 | Pomberger |

(56) References Cited

U.S. PATENT DOCUMENTS

2007/0003366 A1 1/2007 Wedberg
2007/0006543 A1 1/2007 Engström
2007/0011981 A1 1/2007 Eisermann
2007/0028547 A1 2/2007 Grafenauer
2007/0065293 A1 3/2007 Hannig
2007/0094969 A1 5/2007 McIntosh et al.
2007/0094985 A1 5/2007 Grafenauer
2007/0108679 A1 5/2007 Grothaus
2007/0113509 A1 5/2007 Zhang
2007/0151189 A1 7/2007 Yang et al.
2007/0175156 A1 8/2007 Pervan et al.
2007/0193178 A1 8/2007 Groeke et al.
2007/0209736 A1 9/2007 Deringor et al.
2007/0214741 A1 9/2007 Llorens Miravet
2008/0000182 A1 1/2008 Pervan
2008/0000185 A1 1/2008 Duernberger
2008/0000186 A1 1/2008 Pervan et al.
2008/0000187 A1 1/2008 Pervan et al.
2008/0005998 A1 1/2008 Pervan
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0053029 A1 3/2008 Ricker
2008/0066415 A1 3/2008 Pervan
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan
2008/0155930 A1 7/2008 Pervan et al.
2008/0184646 A1 8/2008 Alford
2008/0199676 A1 8/2008 Bathelier et al.
2008/0216434 A1 9/2008 Pervan
2008/0216920 A1 9/2008 Pervan
2008/0236088 A1 10/2008 Hannig et al.
2008/0295432 A1 12/2008 Pervan et al.
2008/0295438 A1 12/2008 Knauseder
2009/0049787 A1 2/2009 Hannig
2009/0100782 A1 4/2009 Groeke et al.
2009/0133353 A1 5/2009 Pervan et al.
2009/0193741 A1 8/2009 Capelle
2009/0193748 A1 8/2009 Boo et al.
2009/0193753 A1 8/2009 Schitter
2009/0217615 A1 9/2009 Engstrom
2009/0308014 A1 12/2009 Muehlebach
2010/0170189 A1 7/2010 Schulte
2010/0293879 A1 11/2010 Pervan et al.
2010/0300031 A1 12/2010 Pervan et al.
2010/0313510 A1 12/2010 Tang
2010/0319290 A1 12/2010 Pervan
2010/0319291 A1 12/2010 Pervan et al.
2011/0030303 A1 2/2011 Pervan et al.
2011/0041996 A1 2/2011 Pervan
2011/0088344 A1 4/2011 Pervan et al.
2011/0088345 A1 4/2011 Pervan
2011/0088346 A1 4/2011 Hannig
2011/0154763 A1 6/2011 Bergelin et al.
2011/0167750 A1 7/2011 Pervan
2011/0167751 A1 7/2011 Engström
2011/0225922 A1 9/2011 Pervan et al.
2011/0252733 A1 10/2011 Pervan
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0151865 A1 6/2012 Pervan et al.
2012/0174515 A1 7/2012 Pervan
2012/0174520 A1 7/2012 Pervan
2012/0279161 A1 11/2012 Håkansson et al.
2013/0008117 A1 1/2013 Pervan
2013/0014463 A1 1/2013 Pervan
2013/0019555 A1 1/2013 Pervan
2013/0042562 A1 2/2013 Pervan
2013/0042563 A1 2/2013 Pervan
2013/0042564 A1 2/2013 Pervan et al.
2013/0042565 A1 2/2013 Pervan
2013/0047536 A1 2/2013 Pervan
2013/0081349 A1 4/2013 Pervan et al.
2013/0111845 A1 5/2013 Pervan
2013/0145708 A1 6/2013 Pervan
2013/0160391 A1 6/2013 Pervan et al.
2013/0232905 A2 9/2013 Pervan
2013/0239508 A1 9/2013 Pervan et al.
2013/0263454 A1 10/2013 Boo et al.
2013/0263547 A1 10/2013 Boo
2013/0318906 A1 12/2013 Pervan et al.
2014/0007539 A1 1/2014 Pervan et al.
2014/0020324 A1 1/2014 Pervan
2014/0033633 A1 2/2014 Kell
2014/0033634 A1 2/2014 Pervan
2014/0053497 A1 2/2014 Pervan et al.
2014/0059966 A1 3/2014 Boo
2014/0069043 A1 3/2014 Pervan
2014/0090335 A1 4/2014 Pervan et al.
2014/0109501 A1 4/2014 Pervan
2014/0109506 A1 4/2014 Pervan et al.
2014/0123586 A1 5/2014 Pervan et al.
2014/0150369 A1 6/2014 Hannig
2014/0190112 A1 7/2014 Pervan
2014/0208677 A1 7/2014 Pervan et al.
2014/0223852 A1 8/2014 Pervan
2014/0237931 A1 8/2014 Pervan
2014/0250813 A1 9/2014 Nygren et al.
2014/0260060 A1 9/2014 Pervan et al.
2014/0283466 A1 9/2014 Boo
2014/0305065 A1 10/2014 Pervan
2014/0366476 A1 12/2014 Pervan
2014/0366477 A1 12/2014 Kell
2014/0373478 A2 12/2014 Pervan et al.
2014/0373480 A1 12/2014 Pervan et al.
2015/0000221 A1 1/2015 Boo
2015/0013260 A1 1/2015 Pervan
2015/0059281 A1 3/2015 Pervan
2015/0089896 A2 4/2015 Pervan et al.
2015/0121796 A1 5/2015 Pervan
2015/0152644 A1 6/2015 Boo
2015/0167318 A1 6/2015 Pervan
2015/0211239 A1 7/2015 Pervan
2015/0233125 A1 8/2015 Pervan et al.
2015/0267419 A1 9/2015 Pervan
2015/0300029 A1 10/2015 Pervan
2015/0330088 A1 11/2015 Derelov
2015/0337537 A1 11/2015 Boo
2015/0368910 A1 12/2015 Kell
2016/0032596 A1 2/2016 Nygren et al.
2016/0060879 A1 3/2016 Pervan
2016/0069088 A1 3/2016 Boo et al.
2016/0076260 A1 3/2016 Pervan et al.
2016/0090744 A1 3/2016 Pervan et al.
2016/0153200 A1 6/2016 Pervan
2016/0168866 A1 6/2016 Pervan et al.
2016/0186426 A1 6/2016 Boo
2016/0194884 A1 7/2016 Pervan et al.
2016/0201336 A1 7/2016 Pervan
2016/0251859 A1 9/2016 Pervan et al.
2016/0251860 A1 9/2016 Pervan
2016/0281368 A1 9/2016 Pervan et al.
2016/0281370 A1 9/2016 Pervan et al.
2016/0326751 A1 11/2016 Pervan
2016/0340913 A1 11/2016 Derelöv
2017/0037641 A1 2/2017 Nygren et al.
2017/0081860 A1 3/2017 Boo
2017/0254096 A1 9/2017 Pervan
2017/0321433 A1 11/2017 Pervan et al.
2017/0362834 A1 12/2017 Pervan et al.
2018/0001509 A1 1/2018 Myllykangas et al.
2018/0001510 A1 1/2018 Fransson
2018/0001573 A1 1/2018 Blomgren et al.
2018/0002933 A1 1/2018 Pervan
2018/0016783 A1 1/2018 Boo
2018/0030737 A1 2/2018 Pervan
2018/0030738 A1 2/2018 Pervan

(56) References Cited

U.S. PATENT DOCUMENTS

| | | | |
|---|---|---|---|
| 2018/0119431 | A1 | 5/2018 | Pervan et al. |
| 2018/0178406 | A1 | 6/2018 | Fransson et al. |
| 2019/0024387 | A1 | 1/2019 | Pervan et al. |
| 2019/0048592 | A1 | 2/2019 | Boo |
| 2019/0048596 | A1 | 2/2019 | Pervan |
| 2019/0063076 | A1 | 2/2019 | Boo et al. |
| 2019/0093370 | A1 | 3/2019 | Pervan et al. |
| 2019/0093371 | A1 | 3/2019 | Pervan |
| 2019/0119928 | A1 | 4/2019 | Pervan et al. |
| 2019/0127989 | A1 | 5/2019 | Kell |
| 2019/0127990 | A1 | 5/2019 | Pervan et al. |
| 2019/0169859 | A1 | 6/2019 | Pervan et al. |
| 2019/0232473 | A1 | 8/2019 | Fransson et al. |
| 2019/0271165 | A1 | 9/2019 | Boo |
| 2019/0376298 | A1 | 12/2019 | Pervan et al. |
| 2019/0394314 | A1 | 12/2019 | Pervan et al. |

FOREIGN PATENT DOCUMENTS

| | | | |
|---|---|---|---|
| DE | 142 293 | C | 7/1902 |
| DE | 2 159 042 | | 6/1973 |
| DE | 25 05 489 | A1 | 8/1976 |
| DE | 33 43 601 | A1 | 6/1985 |
| DE | 33 43 601 | C2 | 6/1985 |
| DE | 39 32 980 | A1 | 11/1991 |
| DE | 42 15 273 | A1 | 11/1993 |
| DE | 42 42 530 | A1 | 6/1994 |
| DE | 196 01 322 | A | 5/1997 |
| DE | 299 22 649 | U1 | 4/2000 |
| DE | 200 01 788 | U1 | 6/2000 |
| DE | 200 02 744 | U1 | 8/2000 |
| DE | 199 40 837 | A1 | 11/2000 |
| DE | 199 58 225 | A1 | 6/2001 |
| DE | 202 05 774 | U1 | 8/2002 |
| DE | 203 20 799 | U1 | 4/2005 |
| DE | 10 2004 055 951 | A1 | 7/2005 |
| DE | 10 2004 001 363 | A1 | 8/2005 |
| DE | 10 2004 002 297 | A1 | 8/2005 |
| DE | 10 2004 054 368 | A1 | 5/2006 |
| DE | 10 2005 024 366 | A1 | 11/2006 |
| EP | 0 013 852 | A1 | 8/1980 |
| EP | 0 871 156 | A2 | 10/1998 |
| EP | 0 974 713 | A1 | 1/2000 |
| EP | 1 120 515 | A1 | 8/2001 |
| EP | 1 146 182 | A2 | 10/2001 |
| EP | 1 251 219 | A | 10/2002 |
| EP | 1 279 778 | A2 | 1/2003 |
| EP | 1 350 904 | A2 | 10/2003 |
| EP | 1 350 904 | A3 | 10/2003 |
| EP | 1 396 593 | A2 | 3/2004 |
| EP | 1 420 125 | A2 | 5/2004 |
| EP | 1 437 457 | A2 | 7/2004 |
| EP | 1 640 530 | A2 | 3/2006 |
| EP | 1 650 375 | A1 | 4/2006 |
| EP | 1 650 375 | A8 | 9/2006 |
| FR | 1.138.595 | | 6/1957 |
| FR | 2 256 807 | | 8/1975 |
| FR | 2 810 060 | A1 | 12/2001 |
| GB | 240629 | | 10/1925 |
| GB | 376352 | | 7/1932 |
| GB | 1171337 | | 11/1969 |
| GB | 2 051 916 | A | 1/1981 |
| JP | 03-110258 | A | 5/1991 |
| JP | 05-018028 | A | 1/1993 |
| JP | 6-146553 | A | 5/1994 |
| JP | 6-288017 | A | 10/1994 |
| JP | 6-306961 | A | 11/1994 |
| JP | 6-322848 | A | 11/1994 |
| JP | 7-300979 | A | 11/1995 |
| JP | 2900115 | B2 | 6/1999 |
| JP | 2002-047782 | A | 2/2002 |
| SE | 526 688 | C2 | 5/2005 |
| SE | 529 076 | C2 | 4/2007 |
| WO | WO 94/26999 | A1 | 11/1994 |
| WO | WO 96/23942 | A1 | 8/1996 |
| WO | WO 96/27721 | A1 | 9/1996 |
| WO | WO 97/47834 | A1 | 12/1997 |
| WO | WO 98/21428 | A1 | 5/1998 |
| WO | WO 98/22677 | A1 | 5/1998 |
| WO | WO 98/58142 | A1 | 12/1998 |
| WO | WO 99/66151 | A1 | 12/1999 |
| WO | WO 99/66152 | A1 | 12/1999 |
| WO | WO 00/20705 | A1 | 4/2000 |
| WO | WO 00/20706 | A1 | 4/2000 |
| WO | WO 00/43281 | A2 | 7/2000 |
| WO | WO 00/47841 | A1 | 8/2000 |
| WO | WO 00/55067 | A1 | 9/2000 |
| WO | WO 01/02669 | A1 | 1/2001 |
| WO | WO 01/02670 | A1 | 1/2001 |
| WO | WO 01/02671 | A1 | 1/2001 |
| WO | WO 01/02672 | A1 | 1/2001 |
| WO | WO 01/07729 | A1 | 2/2001 |
| WO | WO 01/38657 | A1 | 5/2001 |
| WO | WO 01/44669 | A2 | 6/2001 |
| WO | WO 01/44669 | A3 | 6/2001 |
| WO | WO 01/48331 | A1 | 7/2001 |
| WO | WO 01/48332 | A1 | 7/2001 |
| WO | WO 01/51732 | A1 | 7/2001 |
| WO | WO 01/51733 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/94721 | A1 | 12/2001 |
| WO | WO 01/94721 | A8 | 12/2001 |
| WO | WO 01/98604 | A1 | 12/2001 |
| WO | WO 02/48127 | | 6/2002 |
| WO | WO 02/055809 | A1 | 7/2002 |
| WO | WO 02/055810 | A1 | 7/2002 |
| WO | WO 02/081843 | A1 | 10/2002 |
| WO | WO 02/103135 | A1 | 12/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/038210 | A1 | 5/2003 |
| WO | WO 03/044303 | A1 | 5/2003 |
| WO | WO 03/069094 | A1 | 8/2003 |
| WO | WO 03/074814 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/003314 | A1 | 1/2004 |
| WO | WO 2004/016877 | A1 | 2/2004 |
| WO | Wo 2004/020764 | A1 | 3/2004 |
| WO | WO 2004/048716 | A1 | 6/2004 |
| WO | Wo 2004/050780 | A2 | 6/2004 |
| WO | WO 2004/079128 | A1 | 9/2004 |
| WO | WO 2004/079130 | A1 | 9/2004 |
| WO | WO 2004/083557 | A1 | 9/2004 |
| WO | WO 2004/085765 | A1 | 10/2004 |
| WO | WO 2005/003488 | A1 | 1/2005 |
| WO | WO 2005/003489 | A1 | 1/2005 |
| WO | WO 2005/054599 | A1 | 6/2005 |
| WO | WO 2006/043893 | A1 | 4/2006 |
| WO | WO 2006/050928 | A1 | 5/2006 |
| WO | WO 2006/104436 | A1 | 10/2006 |
| WO | WO 2006/123988 | A1 | 11/2006 |
| WO | Wo 2006/125646 | A1 | 11/2006 |
| WO | WO 2007/015669 | A2 | 2/2007 |
| WO | WO 2007/015669 | A3 | 2/2007 |
| WO | WO 2007/019957 | A1 | 2/2007 |
| WO | WO 2007/079845 | A1 | 7/2007 |
| WO | WO 2007/089185 | A1 | 8/2007 |
| WO | WO 2007/141605 | A2 | 12/2007 |
| WO | WO 2007/142589 | A1 | 12/2007 |
| WO | WO 2008/004960 | A2 | 1/2008 |
| WO | WO 2008/004960 | A3 | 1/2008 |
| WO | WO 2008/004960 | A8 | 1/2008 |
| WO | WO 2008/017281 | A1 | 2/2008 |
| WO | WO 2008/017301 | A2 | 2/2008 |

(56) References Cited

FOREIGN PATENT DOCUMENTS

| | | |
|---|---|---|
| WO | WO 2008/017301 A3 | 2/2008 |
| WO | WO 2008/060232 A1 | 5/2008 |

OTHER PUBLICATIONS

U.S. Appl. No. 15/726,853, Darko Pervan, filed Oct. 6, 2017.
Extended European Search Report issued in EP 06799800.5, dated May 6, 2016, European Patent Office, Munich, Germany, 10 pages.
Pervan, Darko, U.S. Appl. No. 15/726,853 entitled "Mechanical Locking System for Panels and Method of Installing Same," filed in the U.S. Patent and Trademark Office dated Oct. 6, 2017.
U.S. Appl. No. 13/670,039, Darko Pervan, filed Nov. 6, 2012 (Cited herein as US Patent Application Publication No, 2013/0081349 A1 of Apr. 4, 2013).
U.S. Appl. No. 13/544,281, Darko Pervan, filed Jul. 9, 2012 (Cited herein as US Patent Application No. 2013/0014463 A1 of Jan. 17, 2013 and as US Patent Application Publication No. 2013/0232905 A2 of Sep. 12, 2013).
U.S. Appl. No. 14/046,235, Darko Pervan, filed Oct. 4, 2013 (Cited herein as US Patent Application Publication No. 2014/0053497 A1 of Feb. 27, 2014).
U.S. Appl. No. 14/258,742, Darko Pervan, filed Apr. 22, 2014 (Cited herein as US Patent Application Publication NO. 2014/0223852 A1 of Aug. 14, 2014).
U.S. Appl. No. 14/315,879, Christian Boo, filed Jun. 26, 2014 (Cited herein as US Patent Application Publication No. 2015/0000221 A1 of Jan. 1, 2015).
U.S. Appl. No. 14/503,780, Darko Pervan, filed Oct. 1, 2014 (Cited herein as US Patent Application Publication No. 2015/0013260 A1 of Jan. 15, 2015).
U.S. Appl. No. 14/538,223, Darko Pervan, filed Nov. 11, 2014, (Cited herein as US Patent Application Publication No. 2015/0059281 A1 of Mar. 5, 2015).
U.S. Appl. No. 14/597,578, Darko Pervan, filed Jan. 15, 2015 (Cited herein as US Patent Application Publication No. 2015/0121796 A1 of May 7, 2015).
U.S. Appl. No. 14/633,480, Darko Pervan, filed Feb. 27, 2015 (Cited herein as US Patent Application Publication No. 2015/0167318 A1 of Jun. 18, 2015).
U.S. Appl. No. 14/709,913, Peter Derelöv, filed May 12, 2015, (Cited herein as US Patent Application Publication No. 2015/0330088 A1 of Nov. 19, 2015).
U.S. Appl. No. 14/938,612, Darko Pervan, filed Nov. 11, 2015 (Cited herein as US Patent Application Publication No. 2016/0060879 A1 of Mar. 3, 2016).
U.S. Appl. No. 14/951,976, Darko Pervan, filed Nov. 25, 2015 (Cited herein as US Patent Application Publication No. 2016/0153200 A1 of Jun. 2, 2016).
U.S. Appl. No. 15/048,252, Darko Pervan, filed Feb. 19, 2016 (Cited herein as US Patent Applicaiton Publication No. 2016/0168866 A1 of Jun. 16, 2016).
U.S. Appl. No. 15/148,820, Darko Pervan, filed May 6, 2016 (Cited herein as US Patent Application Publication No. 2016/0251860 A1 of Sep. 1, 2016).
U.S. Appl. No. 15/160,311, Darko Pervan, filed May 20, 2016.
U.S. Appl. No. 15/175,768, Darko Pervan, filed Jun. 7, 2016.
U.S. Appl. No. 15/217,023, Darko Pervan, filed Jul. 22, 2016.
U.S. Appl. No. 15/229,575, Peter Derelöv, filed Aug. 5, 2016.
U.S. Appl. No. 15/261,071, Darko Pervan, filed Sep. 9, 2016.
International Search Report dated Apr. 25, 2007 in PCT/SE2006/001218, Swedish Patent Office; Stockholm, SE, 9 pgs.
LifeTips, "Laminate Flooring Tips," available at (http://flooring.lifetips.com/cat/61734/laminate-flooring-tips/index.html), 2000, 12 pages.
Välinge Innovation AB, Technical Disclosure entitled "Mechanical locking for floor panels with a flexible bristle tongue," IP.com number: IPCOM000145262D, Jan. 12, 2007, IP.com PriorArtDatabase, 57 pages.
Pervan, Darko, U.S. Appl. No. 15/160,311, entitled "Mechanical Locking System for Floor Panels," filed in the U.S. Patent and Trademark Office May 20, 2016.
Pervan, Darko, et al., U.S. Appl. No. 15/175,768, entitled "Mechanical Locking System for Floor Panels," filed in the U.S. Patent and Trademark Office on Jun. 7, 2016.
Pervan, Darko, et al., U.S. Appl. No. 15/217,023, entitled "Mechanical Locking System for Floor Panels," filed in the U.S. Patent and Trademark Office on Jul. 22, 2016.
Derelov, Peter, U.S. Appl. No. 15/229,575, entitled "Building Panel With a Mechanical Locking System," filed in the U.S. Patent and Trademark Office on Aug. 5, 2016.
Pervan, Darko, U.S. Appl. No. 15/261,071, entitled "Mechanical Locking System for Floor Panels," filed in the U.S. Patent and Trademark Office on Sep. 9, 2016.
U.S. Appl. No. 15/365,546, Christian Boo, filed Nov. 30, 2016 (Cited herein as US Patent Application Publication No. 2017/0081860 A1 of Mar. 23, 2017).
Pervan, Darko, U.S. Appl. No. 15/813,855 entitled "Mechanical Locking of Floor Panels with a Glued Tongue," filed in the U.S. Patent and Trademark Office Nov. 15, 2017.
Pervan, Darko, et al., U.S. Appl. No. 15/855,389 entitled "Mechanical Locking System for Floor Panels," filed in the U.S. Patent and Trademark Office on Dec. 27, 2017.
Pervan, Darko, et al., U.S. Appl. No. 15/896,571 entitled "Mechanical Locking of Floor Panels with a Flexible Tongue," filed in the U.S. Patent and Trademark Office on Feb. 14, 2018.
U.S. Appl. No. 15/813,855, Darko Pervan, filed Nov. 15, 2017.
U.S. Appl. No. 15/855,389, Darko Pervan and Tony Pervan, filed Dec. 27, 2017.
U.S. Appl. No. 15/896,571, Darko Pervan, Niclas Håkansson and Per Nygren, filed Feb. 14, 2018.
U.S. Appl. No. 16/143,610, Darko Pervan, filed Sep. 27, 2018.
U.S. Appl. No. 16/163,088, Darko Pervan, filed Oct. 17, 2018.
Pervan, Darko, U.S. Appl. No. 16/143,610 entitled "Mechanical Locking System for Panels and Method of Installing Same," filed in the U.S. Patent and Trademark Office on Sep. 27, 2018.
Pervan, Darko, U.S. Appl. No. 16/163,088 entitled "Mechanical Locking System for Floor Panels," filed in the U.S. Patent and Trademark Office on Oct. 17, 2018.
U.S. Appl. No. 16/224,951, Darko Pervan and Tony Pervan, filed Dec. 19, 2018.
Pervan, Darko, et al., U.S. Appl. No. 16/224,951 entitled "Mechanical Locking System for Floor Panels," filed in the U.S. Patent and Trademark Office on Dec. 19, 2018.
U.S. Appl. No. 16/269,806, Darko Pervan and Tony Pervan, filed Feb. 7, 2019.
Pervan, Darko, et al., U.S. Appl. No. 16/269,806 entitled "Mechanical Locking System for Floor Panels," filed in the U.S. Patent and Trademark Office on Feb. 7, 2019.
U.S. Appl. No. 16/581,990, Darko Pervan, filed Sep. 25, 2019.
U.S. Appl. No. 16/692,104, Darko Pervan, filed Nov. 22, 2019.
Pervan, Darko, U.S. Appl. No. 16/581,990 entitled "Mechanical Locking System for Floor Panels," filed in the U.S. Patent and Trademark Office on Sep. 25, 2019.
Pervan, Darko, U.S. Appl. No. 16/692,104 entitled "Mechanical Locking System for Floor Panels," filed in the U.S. Patent and Trademark Office on Nov. 22, 2019.
Boo, Christian, U.S. Appl. No. 16/419,660 entitled "Building Panel With a Mechanical Locking System," filed in the U.S. Patent and Trademark Office on May 22, 2019.
Pervan, Darko, U.S. Appl. No. 16/439,827 entitled "Mechanical Locking of Floor Panels With Vertical Folding," filed in the U.S. Patent and Trademark Office on Jun. 13, 2019.
Extended European Search Report issued in EP 17180642.5, dated Nov. 10, 2017, European Patent Office, Munich, Germany, 10 pages.
**Ylikangas, Roger, et al., U.S. Appl. No. 16/713,373 entitled "Unlocking System for Panels," filed in the U.S. Patent and Trademark Office dated Dec. 13, 2019.

(56) References Cited

OTHER PUBLICATIONS

**Pervan, Darko, U.S. Appl. No. 16/781,301 entitled "Mechanical Locking of Floor Panels," filed in the U.S. Patent and Trademark Office dated Feb. 4, 2020.

* cited by examiner

Prior Art

Prior Art

Prior Art

Prior Art

MECHANICAL LOCKING OF FLOOR PANELS WITH A FLEXIBLE BRISTLE TONGUE

CROSS-REFERENCE TO RELATED APPLICATIONS

The present application is a continuation of U.S. application Ser. No. 14/463,972, filed on Aug. 20, 2014, which is a continuation of U.S. application Ser. No. 13/728,121, filed on Dec. 27, 2012, now U.S. Pat. No. 8,844,236, which is a continuation of U.S. application Ser. No. 13/195,297, filed on Aug. 1, 2011, now U.S. Pat. No. 8,359,805, which is a continuation of application Ser. No. 12/788,384, filed on May 27, 2010, now U.S. Pat. No. 8,033,074, which is a continuation of application Ser. No. 11/775,885, filed on Jul. 11, 2007, now U.S. Pat. No. 7,908,815, which is a continuation-in-part of International Application No. PCT/SE2006/001218, filed on Oct. 27, 2006, and which claims the benefit of U.S. Provisional Application No. 60/806,975, filed on Jul. 11, 2006, and of Swedish Application No. SE 0601550-7, filed in Sweden on Jul. 11, 2006. The entire contents of each of U.S. application Ser. No. 14/463,972, U.S. application Ser. No. 13/728,121, U.S. Pat. No. 8,844,236, U.S. application Ser. No. 13/195,297, U.S. Pat. No. 8,359,805, U.S. application Ser. No. 12/788,384, U.S. Pat. No. 8,033,074, U.S. application Ser. No. 11/775,885, U.S. Pat. No. 7,908,815, International Application No. PCT/SE2006/001218, U.S. Provisional Application No. 60/806,975 and Swedish Application No. SE 0601550-7 are hereby incorporated herein by reference in their entirety.

FIELD OF INVENTION

The invention generally relates to the field of floor panels with mechanical locking systems with a flexible and displaceable tongue. The invention also relates to a partly bendable tongue for a building panel with such a mechanical locking system.

BACKGROUND

In particular, yet not restrictive manner, the invention concerns a tongue for a floor panel and a set of floor panels mechanically joined to preferably a floating floor. However, the invention is as well applicable to building panels in general. More particularly invention relates to the type of mechanically locking systems comprising a flexible or partly flexible tongue and/or displaceable tongue, in order to facilitate the installation of building panels.

A floor panel of this type is presented in WO 2006/043893, which discloses a floor panel with a locking system comprising a locking element cooperating with a locking groove, for horizontal locking, and a flexible tongue cooperating with a tongue groove, for locking in a vertical direction. The flexible tongue bends in the horizontal plane during connection of the floor panels and makes it possible to install the panels by vertical folding or solely by vertical movement. By "vertical folding" is meant a connection of three panels where a first and second panel are in a connected state and where a single angling action connects two perpendicular edges of a new third panel, at the same time, to the first and the second panel. Such a connection takes place for example when a long side of the first panel in a first row is already connected to a long side of a second panel in a second row. The third panel, which in this text is referred to as "folding panel" is then connected by angling to the long side of the first panel in the first row. This specific type of angling action, which also connects the short side of the new third panel and second panel in the second row, is referred to as "vertical folding". It is also possible to connect two panels by lowering a whole panel solely by a substantially vertical movement against another panel where no substantial turning of the panel edge is involved. This connection of two panels is referred to as "vertical locking."

Similar floor panels are further described in WO 2003/016654, which discloses locking system comprising a tongue with a flexible tab. The tongue is extending and bending essentially in a vertical direction and the tip of the tab cooperates with a tongue groove for vertical locking. The flexible tab is directed upwards and located on the folding panel. The major disadvantage of such an embodiment is that the flexible tab must be displaced inwards by a sharp panel edge as shown in FIG. 17*a*.

DEFINITION OF SOME TERMS

In the following text, the visible surface of the installed floor panel is called "front face", while the opposite side of the floor panel, facing the sub floor, is called "rear face". The edge between the front and rear face is called "joint edge". By "horizontal plane" is meant a plane, which extends parallel to the outer part of the surface layer. Immediately juxtaposed upper parts of two adjacent joint edges of two joined floor panels together define a "vertical plane" perpendicular to the horizontal plane.

By "joint" or "locking system" are meant co acting connecting means, which connect the floor panels vertically and/or horizontally. By "mechanical locking system" is meant that joining can take place without glue. Mechanical locking systems can in many cases also be combined with gluing. By "integrated with" means formed in one piece with the panel or factory connected to the panel.

By a "flexible tongue" is meant a separate tongue which has a length direction along the joint edges and which is forming a part of the vertical locking system and could be displaced horizontally during locking. The tongue could, for example, be bendable or have a flexible and resilient part in such a way that it can bend along its length and spring back to its initial position.

By "angling" is meant a connection that occurs by a turning motion, during which an angular change occurs between two parts that are being connected, or disconnected. When angling relates to connection of two floor panels, the angular motion takes place with the upper parts of joint edges at least partly being in contact with each other, during at least part of the motion.

SUMMARY

Embodiments of the present invention relate to a set of floor panels or a floating flooring and tongue for a floor panel, which provides for new embodiments according to different aspects offering respective advantages. Useful areas for the invention are floor panels of any shape and material e.g. laminate, wood, HDF, veneer or stone.

According to a first object, an embodiment of the invention provides for a set of floor panels comprising a mechanically locking system at two adjacent edges of a first and a second panel, whereby the locking system is configured to connect a first panel to a second panel in the horizontal and vertical plane. The locking system is provided, in order to facilitate the installation, with a displaceable tongue for locking in the vertical plane. The tongue is displaceable in a displacement groove in the edge of one of the floor panels and is configured to cooperate with a tongue groove in the other of said floor panels. A first long edge of the tongue comprises at least two bendable protrusions extending essentially in the horizontal plane and bendable in the horizontal plane. A second long edge of the tongue, which in the connected state extends outside the displacement groove, has an essentially straight outer edge over substantially the whole length of the tongue.

As the floor panel according to embodiments of the first object of the invention is provided with a displaceable tongue with bendable protrusions and an essentially straight outer edge this offers several advantages. A first advantage consists in that the floor panels are locked in the vertical direction along substantially the whole length of the tongue. A second advantage is that it is possible to mould the tongues in one part in e.g. plastic material and if desired to cut them up in shorter tongues, which all have essentially the same properties. The same moulding tool could be used to produce flexible tongues for different panel widths. Especially the displacement resistance and the locking strength per length unit could be achieved. A third advantage is that the displacement resistance, due to the bending of the protrusions, is essentially the same along the whole tongue. A larger number of protrusions provides for a more constant displacement resistance along the edge of the tongue. If the panels are installed by vertical folding a constant displacement resistance over the length of the tongue is desired. Also a high angle between the fold panel and the second panel when the fold panel initially contact the tongue in the second panel is provided. The protrusions are designed to allow displacement but also to prevent tilting of the tongue.

A floor panel is known from WO 2006/043893, as mentioned above, and discloses a bow shaped flexible tongue bendable in the length direction. The drawback of this bow shaped tongue is that due to the shape, there is no locking at the end of the tongue. One embodiment is shown that provides locking along the whole length (FIG. 7*f*), but that tongue consists of two connected parts (38, 39). It is also important that the tongue easily springs back after being displaced into the displacement groove during installation. Therefore it is advantageously if the part of the tongue which cooperate with the adjacent panel is relatively stable and is provided with sliding surfaces with an area enough to avoid that the tongue get stuck before reaching its final position for vertical locking. A sliding surface at the tip of a tab or a protrusion is therefore not a useful solution.

Advantageously, the protrusions of the tongue are bow shaped, providing an essentially constant moment arm during installation of the panels and bending of the protrusions.

Preferably, the tongue comprises a recess at each protrusion, resulting in avoiding of deformation and cracking of the protrusion if the tongue is displaced too far and too much force is applied.

Preferably, the length of the tongue is of more than 90% of the width WS of front face of the panel; in other preferred embodiments the length of the tongue is preferably in the range from 75% to substantially the same as the width WS of front face.

According to a second object, an embodiment of the invention provides for a tongue for a building panel, said tongue is of an elongated shape and made of moulded plastic. The tongue comprises at least two protrusions at a first long edge of the tongue. The protrusions are bendable in a plane parallel to the upper surface of the tongue and extending essentially in the parallel plane. Furthermore, the tongue has a second long edge, which is essentially straight over substantially the whole length of the tongue.

A first advantage consists in that the tongue provides for locking in the vertical direction along the whole length of the tongue. A second advantage is that it is possible to mould the tongue in one part in plastic and, if desired, cut the tongue into shorter tongues, which all have essentially the same properties. Especially the displacement resistance and the locking strength per length unit are essentially the same. A third advantage is that the displacement resistance, due to the bending of the protrusions, is essentially the same along the whole tongue. A larger number of protrusions provides for a more constant displacement resistance along the edge of the tongue. Even rather rigid materials such as reinforced plastic, metals, for example aluminum and wood may be made flexible with protrusions according to the principle of the invention. If the panels are installed by vertical folding, e.g., by the installation method explained below (see FIG. 5), a constant displacement resistance is desired According to a third object, an embodiment of the invention provides for a set of floor panels comprising a mechanically locking system at two adjacent edges of a first and a second panel, whereby the locking system is configured to connect a first panel to a second panel in the horizontal and vertical plane. The locking system is provided, in order to facilitate the installation, with a displaceable tongue for locking in the vertical plane. The tongue is displaceable in a displacement groove in the edge of one of the floor panels and is configured to cooperate with a tongue groove in the other of said floor panels. At least one long edge of the tongue, which in the connected state extends outside the displacement groove, comprises at least two bendable protrusions extending essentially in the horizontal plane and bendable in the horizontal plane. This embodiment with displaceable and bendable protrusions at the outer edge offers several advantages. The whole tongue may also be displaceable. A first advantage consists in that only a part of the tongue has to be pressed into the displacement groove during folding and this will decrease the friction force that has to be overcome during folding. The protrusions are in one embodiment slightly thinner than the body of the tongue. A small play of about 0.01 to about 0.10 mm may for example be provide between at least a part of the protrusion and the displacement groove and this play could substantially eliminate friction during displacement even in the case when the groove, due to production tolerances, is slightly smaller than the tongue body. A second advantage is that the protrusions could spring back independently of each other and a more reliable locking is obtained even in cases where the friction forces varies due to production tolerances of the displacement groove and/or the tongue groove.

According to a fourth object, an embodiment of the invention provides for a locking system for floor panels comprising a mechanically locking system at two adjacent edges of a first and a second panel, whereby the mechanically locking system comprising a first connector for locking in a horizontal direction (D2) perpendicular to the adjacent edges and a second connector comprising, in order to facilitate the installation, a separate tongue, preferably made of a separate material than the core of the panel, for locking in a vertical direction (D1). A part of the tongue is flexible and bendable in the horizontal and/or vertical plane. The locking system is configured to connect a first panel to a second panel by angling, snapping, vertical folding and vertical locking. Such a locking system offers the advantage that the panels could be locked in several ways and this facilitates installation.

According to a fifth object, an embodiment of the invention comprises an installation method to connect panels preferably floor panels. The panels comprise short sides with a mechanical locking system for locking the adjacent short edges vertically with a separate tongue comprising a flexible part and horizontally with a locking strip comprising a locking element and long sides with a mechanical locking system comprising a tongue, a groove a locking strip and a locking groove that allows vertical and horizontal locking by angling. The method comprising the steps of:

a) Installing a second row of panels by connecting the short sides of the panels with vertical locking or horizontal snapping whereby the flexible part of the tongue is displaced b) Connecting the second row to an adjacent and already installed first row by angling.

All references to "a/an/the [element, device, component, means, step, etc.]" are to be interpreted openly as referring to at least one instance of said element, device, component, means, step, etc., unless explicitly stated otherwise.

DESCRIPTION OF EMBODIMENTS OF THE INVENTION

As represented in FIGS. 5-17, the disclosure relates to a set of floor panels with a displaceable tongue, displaceable tongue for a floor panel, a locking system for floor panels and a method to install floor panels.

A known art floor panel 1, 1' provided with a mechanical locking system and a displaceable tongue is described with reference to FIGS. 1*a*-1*d*.

Figure 1A:
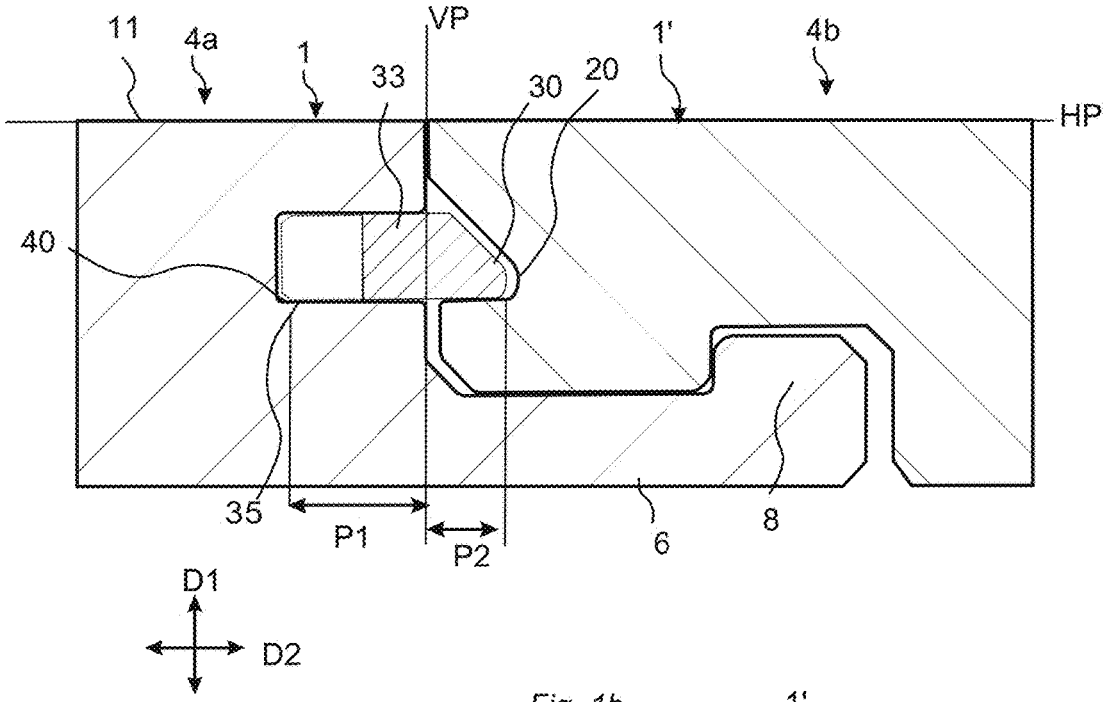
FIGS. 1*a-d* illustrate a known art locking system.
Figure 1B:
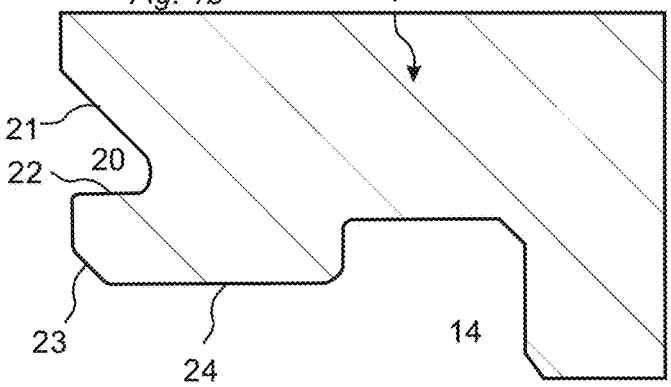
Figure 1C:
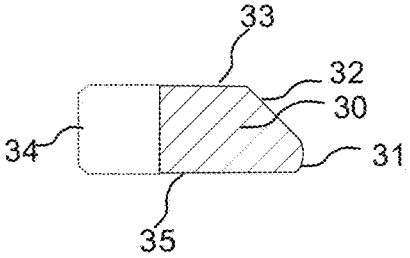
Figure 1D:
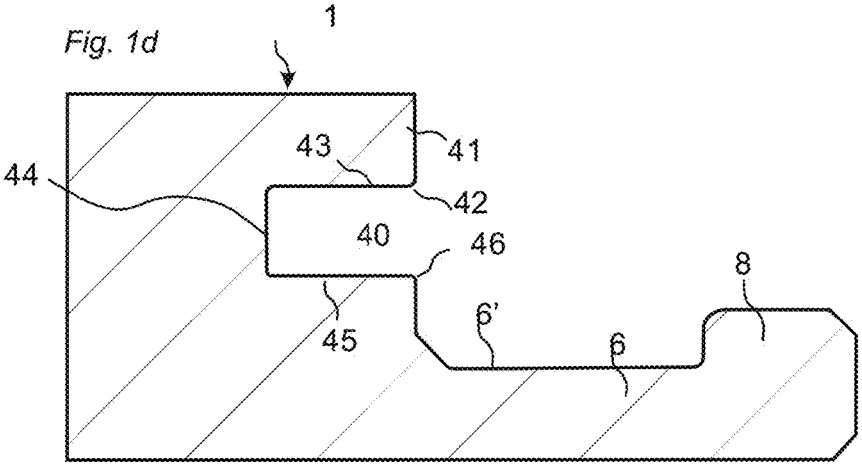

FIG. 1*a* illustrates schematically a cross-section of a joint between a short side joint edge 4*a* of a panel 1 and an opposite short side joint edge 4*b* of a second panel 1'.

The front faces of the panels are essentially positioned in a common horizontal plane HP, and the upper parts 21, 41 of the joint edges 4*a*, 4*b* abut against each other in a vertical plane VP. The mechanical locking system provides locking of the panels relative to each other in the vertical direction D1 as well as the horizontal direction D2.

To provide joining of the two joint edges in the D1 and D2 directions, the edges of the floor panel have in a manner known per se a locking strip 6 with a locking element 8 in one joint edge, hereafter referred to as the "strip panel" which cooperates with a locking groove 14 in the other joint edge, hereafter referred to as the "fold panel", and provides the horizontal locking.

The known art mechanical locking system comprises a separate flexible tongue 30 fixed into a displacement groove 40 formed in one of the joint edges. The flexible tongue 30 has a groove portion P1, which is located in the displacement groove 40 and a projecting portion P2 projecting outside the displacement groove 40. The projecting portion P2 of the flexible tongue 30 in one of the joint edges cooperates with a tongue groove 20 formed in the other joint edge.

The flexible tongue 30 has a protruding part P2 with a rounded outer part 31 and a sliding surface 32, which in this embodiment if formed like a bevel. It has upper 33 and lower 35 tongue displacement surfaces and an inner part 34.

The displacement groove 40 has an upper 42 and a lower 46 opening, which in this embodiment are rounded, a bottom 44 and upper 43 and lower 45 groove displacement surfaces, which preferably are essentially parallel with the horizontal plane HP.

The tongue groove 20 has a tongue-locking surface 22, which cooperates with the flexible tongue 30 and locks the joint edges in a vertical direction D1. The fold panel 1' has a vertical locking surface 24, which is closer to the rear face 62 than the tongue groove 20. The vertical locking surface 24 cooperates with the strip 6 and locks the joint edges in another vertical direction. The fold panel has in this embodiment a sliding surface 23 which cooperated during locking with the sliding surface 32 of the tongue.

Figure 3A:
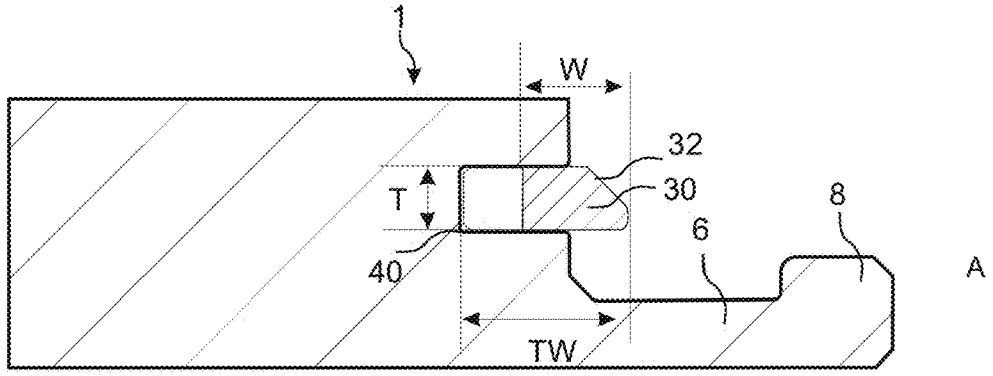
FIGS. 3*a-b* show a floor panels with a known art mechanical locking system on a short side.
Figure 3B:
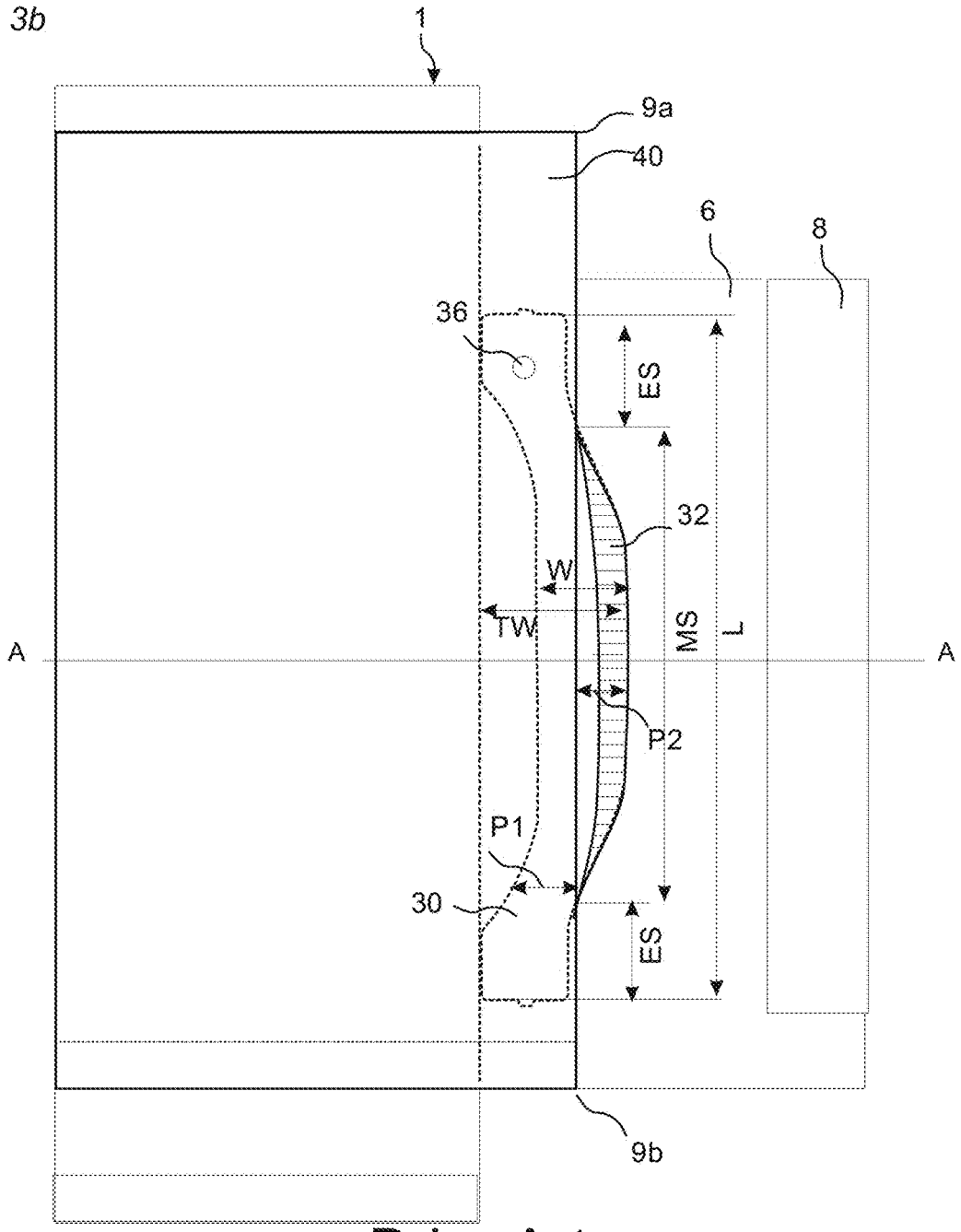

FIG. 3*a* shows a cross section A-A of a panel according to FIG. 3*b* seen from above. The flexible tongue 30 has a length L along the joint edge, a width W parallel to the horizontal plane and perpendicular to the length L and a thickness T in the vertical direction D1. The sum of the largest groove portion P1 and the largest protruding part P2 is the total width TW. The flexible tongue has also in this embodiment a middle section MS and two edge sections ES adjacent to the middle section. The size of the protruding part P2 and the groove portion P1 varies in this embodiment along the length L and the tongue is spaced from the two corner sections 9*a* and 9*b*. The flexible tongue 30 has on one of the edge sections a friction connection 36 which could be shaped for instance as a local small vertical protrusion. This friction connection keeps the flexible tongue in the displacement groove 40 during installation, or during production, packaging and transport, if the flexible tongue is integrated with the floor panel at the factory.

Figure 2A:
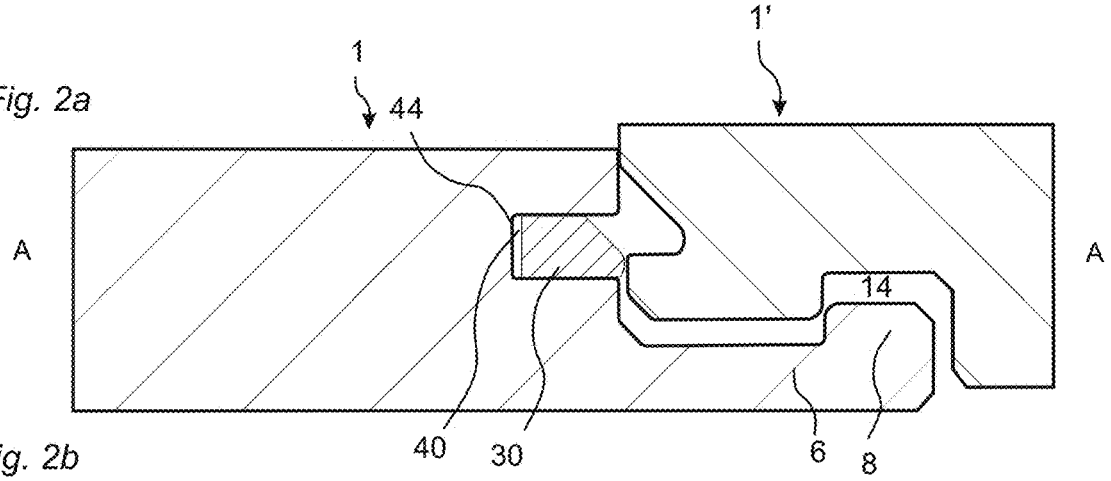
FIGS. 2*a-b* show a known art flexible tongue during the locking action.
Figure 2B:
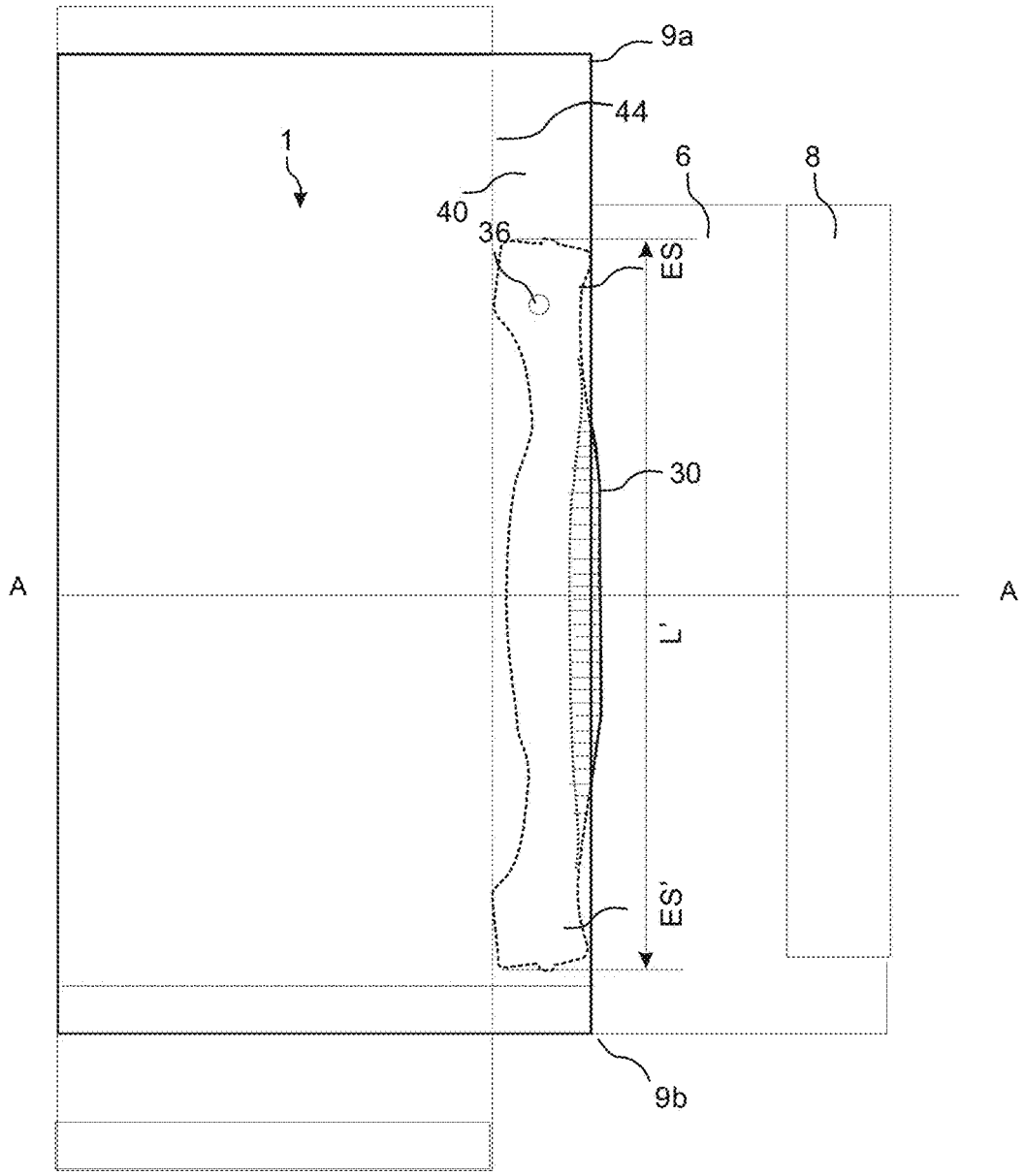

FIGS. 2*a* and 2*b* show the position of the flexible tongue 30 after the first displacement towards the bottom 44 of the displacement groove 40. The displacement is caused essentially by bending of the flexible tongue 30 in its length direction L parallel to the width W. This feature is essential for this known art.

The fold panel could be disconnected with a needle shaped tool, which could be inserted from the corner section 9*b* into the tongue grove 20 and press the flexible tongue back into the displacement groove 40. The fold panel could then be angled up while the strip panel is still on the sub floor. Of course the panels could also be disconnected in the traditional way.

Figure 4A:
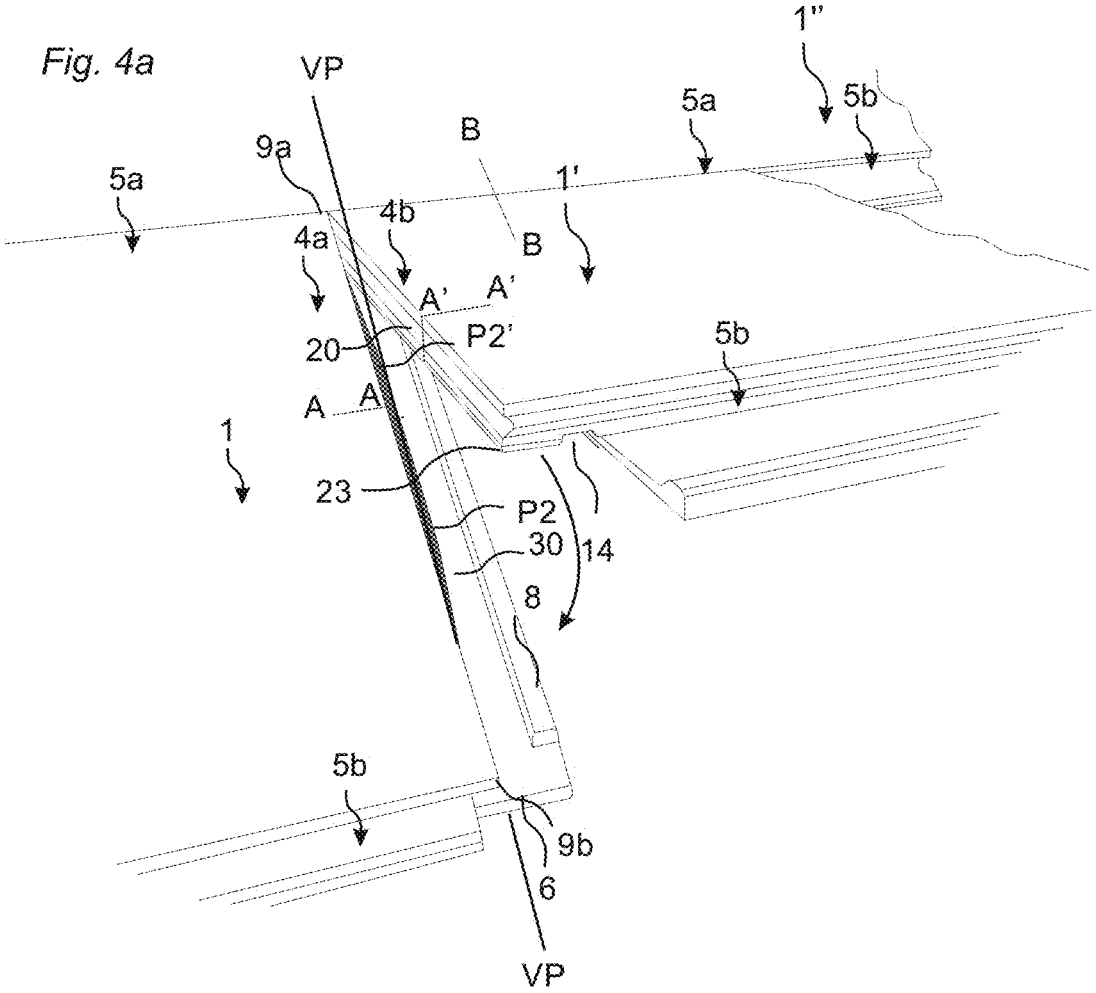
FIGS. 4*a-b* show how short sides of two floor panels could be locked with vertical folding according to known art.
Figure 4B:
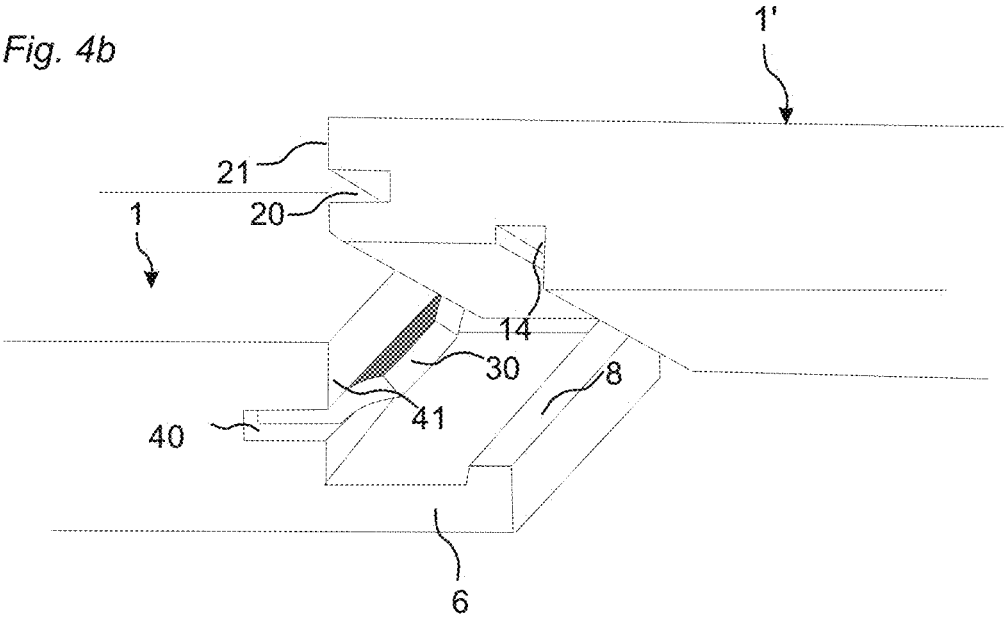

FIGS. 4*a* and 4*b* show one embodiment of a vertical folding. A first panel 1" in a first row is connected to a second 1 panel in a second row. The new panel 1' is connected with its long side 5*a* to the long side 5*b* of the first panel with angling. This angling action also connects the short side 4*b* of the new pane with the short side 4*a* of the second panel. The fold panel 1' is locked to the strip panel 1 with a combined vertical and turning motion along the vertical plane VP. The protruding part P2 has a rounded and or angled folding part P2' which during folding cooperates with the sliding surface 23 of the folding panel 1'. The combined effect of a folding part P2', and a sliding surface 32 of the tongue which during the folding cooperates with the sliding surface 23 of the fold panel 1' facilitates the first displacement of the flexible tongue 30. An essential feature of this embodiment is the position of the projecting portion P2, which is spaced from the corner section 9*a* and 9*b*. The spacing is at least 10% of the length of the joint edge, in this case the visible short side 4*a*.

Figure 5A:
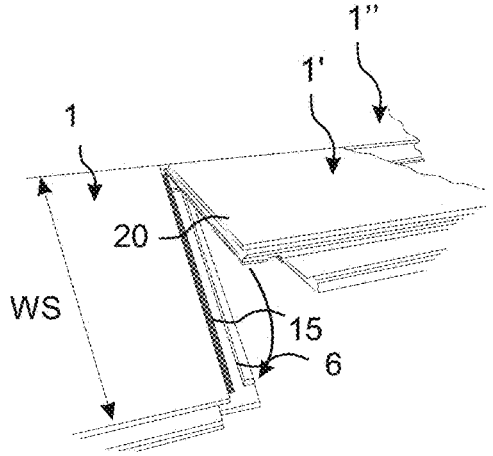
FIGS. 5*a-c* show panels according to one embodiment of the invention and a preferred locking method.
Figure 5B:
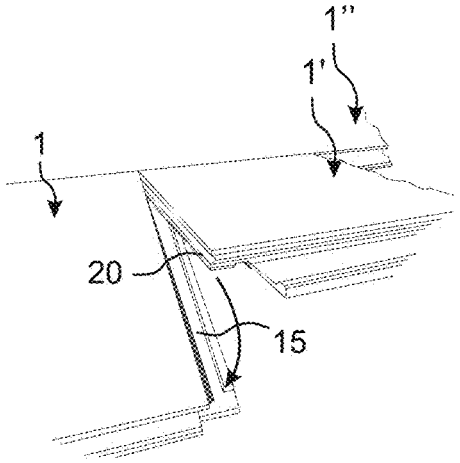
Figure 5C:
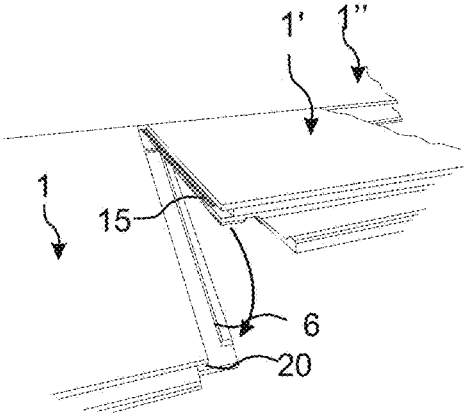

FIGS. 5*a*-5*c* show an embodiment of the set of floor panels with a displaceable tongue according to the invention and a preferred installation method. In this embodiment the length of the tongue is of more than 90% of the width WS of front face of the panel, in other preferred embodiments the length of the tongue is preferably in the range from 75% to substantially the same as the width WS of front face. Preferably, the length of the tongue is about the total width of the panel minus the width of the locking system of the adjacent edges of the panel. A small bevel may be provided at the ends of the outer edge, but the straight part of the tongue at the outer edge has preferably a length substantially equal to the length of the tongue or desirably more than 90%. The new panel 1' is in angled position with an upper part of the joint edge in contact with the first panel 1" in the first row. The new panel 1' is then displaced towards the second panel 1 until the edges are essentially in contact and a part of the flexible tongue 15 is pressed into the displacement groove 40 as can be seen in the FIG. 5*b*. The new panel 1' is then folded down towards the second panel 1. Since the displacement of the new panel 1' presses only an edge section of the flexible tongue 15 into the displacement groove 40, vertical folding will be possible to make with less resistance. Installation could be made with a displaceable tongue that has a straight outer edge. When panels with the known bow shaped tongue 30 (see FIG. 2-4) are installed the whole tongue has to be pressed into the displacement groove. When comparing the known bow shaped tongue with a tongue according to the invention less force is needed for a tongue with the same spring constant per length unit of the tongue. It is therefore possible, using the principles of the invention, to use a tongue with higher spring constant per length unit and higher spring back force, resulting in more reliable final position of the tongue. With this installation method, the beveled sliding surface of the fold panel is not necessary, or may be smaller, which is an advantage for thin panels. If the tongue is not long enough, the installation method above is not working and the beveled sliding surface of the fold panel is needed. FIG. 5*c* show that the tongue could be on the folding panel.

A preferred production method according to the invention is injection moulding. With this production method a wide variety of complex three-dimensional shapes could be produced at low cost and the flexible tongues 15 may easily be connected to each other to form tongue blanks 50. A tongue could also be made of an extruded or machined plastic or metal section, which could be further shaped with for example punching to form a flexible tongue according to the invention. The drawback with extrusion, besides the additional productions steps, is that it is hard to reinforce the tongue, e.g. by fibres.

As can be seen when comparing FIGS. 5 and 4, the angle between the new panel 1' and the second panel 1 is higher, for the panels with the tongue according to an embodiment of the invention, when the new panel initially contacts the end of the tongue 15 and begins to displace the tongue into the displacement groove 40. It is an advantage if the angle is higher, since a higher angle means a more comfortable working position in which it is easier to apply a higher force pushing the tongue into the displacement groove.

Any type of polymer materials could be used such as PA (nylon), POM, PC, PP, PET or PE or similar having the properties described above in the different embodiments. These plastic materials could be when injection moulding is used be reinforced with for instance glass fibre, Kevlar fibre, carbon fibre or talk or chalk. A preferred material is glass fibre, preferably extra-long, reinforced PP or POM.

FIGS. 6*a*-*e* show embodiments of the tongue 15 according to the invention. They are all configured to be inserted in a groove in a floor panel, in a similar way as described for the known art tongues and panels in reference to FIGS. 1-4 above. All methods to injection mould, insert and also the tool for disassembling described in WO2006/043893 and partly in the description and FIGS. 1-4 above are applicable to the invention.

Figure 6A:
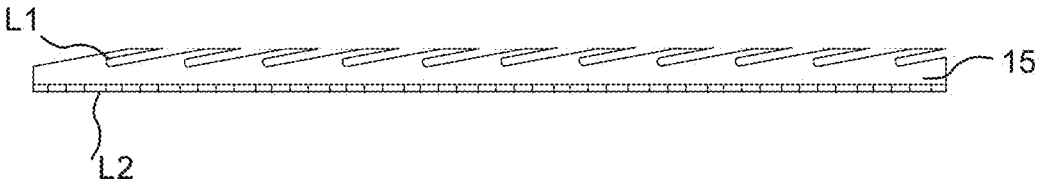
FIGS. 6*a-e* show displaceable tongues in embodiments according to the invention.

FIG. 6*a* shows an embodiment with a first long edge L1 and a second long edge L2. The first long edge has protrusions extending in a plane parallel to the topside 64 of the tongue 15 and with an angle relative the longitudinal direction of the tongue.

Figure 6B:
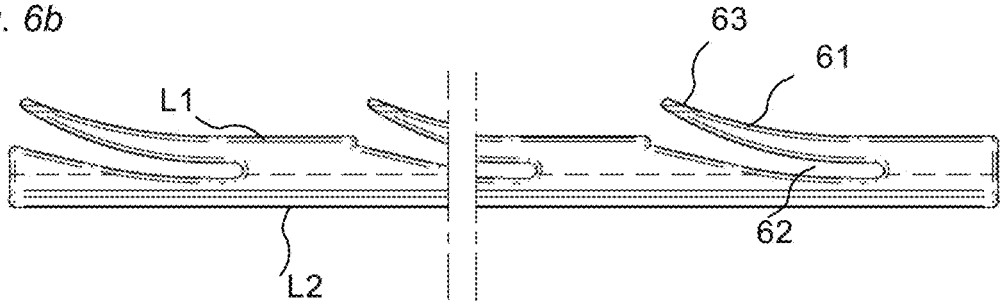

FIGS. 6*a*-*b* show the embodiment, in top and in a side view, with a first long edge L1 and a second long edge L2. The first long edge has protrusions 61 extending in a plane parallel to the topside, an upper displacement surface 61, and rear side, a lower displacement surface, of the tongue and with an angle relative the longitudinal direction of the tongue. The protrusions are preferably bow shaped and, in a particular preferred embodiment, the tongue is provided with a recess 62 at each protrusion 61. The recess is preferably adapted to the size and shape of the protrusion.

The protrusions are preferably provided with a friction connection 63, most preferably close to or at the tip of the protrusion, which could be shaped for instance as a local small vertical protrusion. This friction connection keeps the flexible tongue in the displacement groove 40 during installation, or during production, packaging and transport, if the displaceable tongue is integrated with the floor panel at the factory.

Figure 6C:
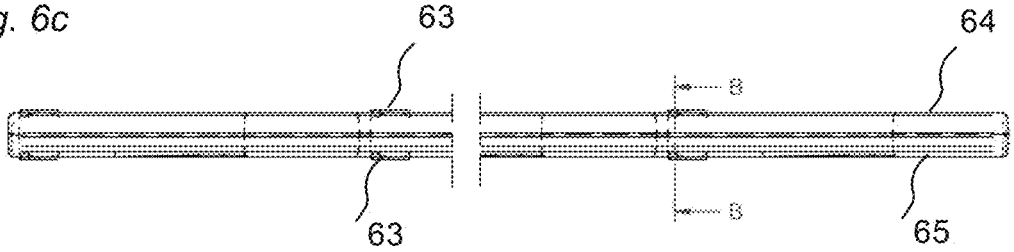
Figure 6D:
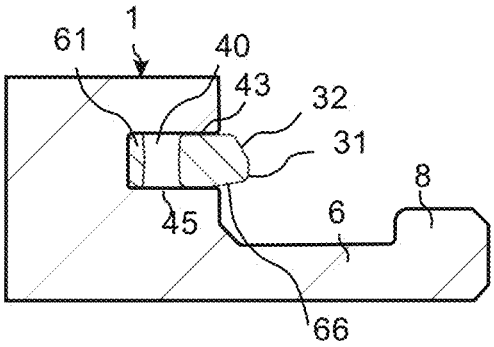

FIG. 6*d* shows the tongue 15 in the cross section B-B in FIG. 6*c* and positioned in the displacement groove 40 of a panel 1. The upper and lower displacement surface of the tongue is configured to cooperate with an upper 43 and a lower 45 groove displacement surfaces. The panel comprises a locking strip 6 and a locking element 8 for horizontal locking. The panel 1 is configured to be connected to a second panel 1' in a similar way as the known art panel 1' in FIG. 1*a*-1*d*. The upper displacement surface (64) and/or the lower displacement surface (65) of the tongue is in one preferred embodiment provided with a beveled edge, presenting a sliding surface (32, 31) and an inclined locking surface (66), respectively. The inclined locking surface cooperates preferably with an inclined tongue-locking surface 22 in the tongue groove (20).

Figure 6E:
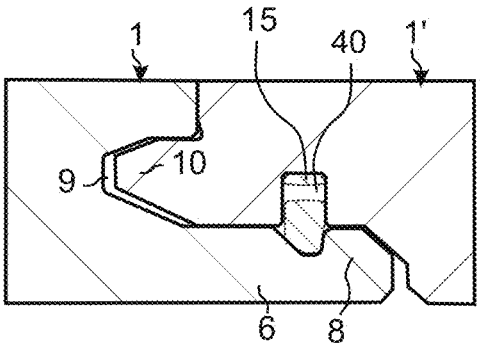

In embodiments according to FIGS. 6*d* and 6*e*, the displacement groove (40) is formed in one piece with the core of the panel, but other alternatives are possible. The displacement groove may be formed in a separate material, for example HDF, which is connected to a wood core in a parquet floor. The displacement grove may be formed of U-shaped plastic or metal sections, which are connected to the panel with for example a snap connection, glue or friction. These alternatives could be used to reduce friction and to facilitate horizontal displacement of the tongue in the displacement grove. The displacement groove may also be treated with a friction reducing agent. These principles may also be applied to the tongue groove.

FIG. 6*e* shows that the tongue 15 may also be inserted into the displacement groove 40 of a panel for locking in the horizontal plane. The tongue is displaced in the vertical plane during connection of the panels. These types of panels are connected by a movement in the horizontal plane—"horizontal snapping".

Figure 8A:
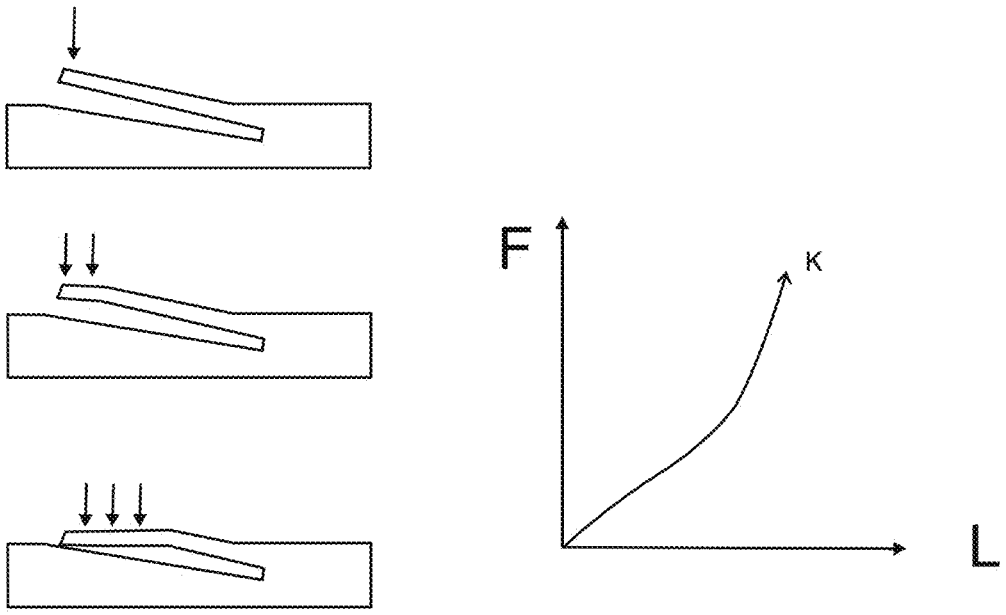
FIGS. 8*a-b* show the bending of the protrusion of the tongue, during installation, according to embodiments of the invention.
Figure 8B:
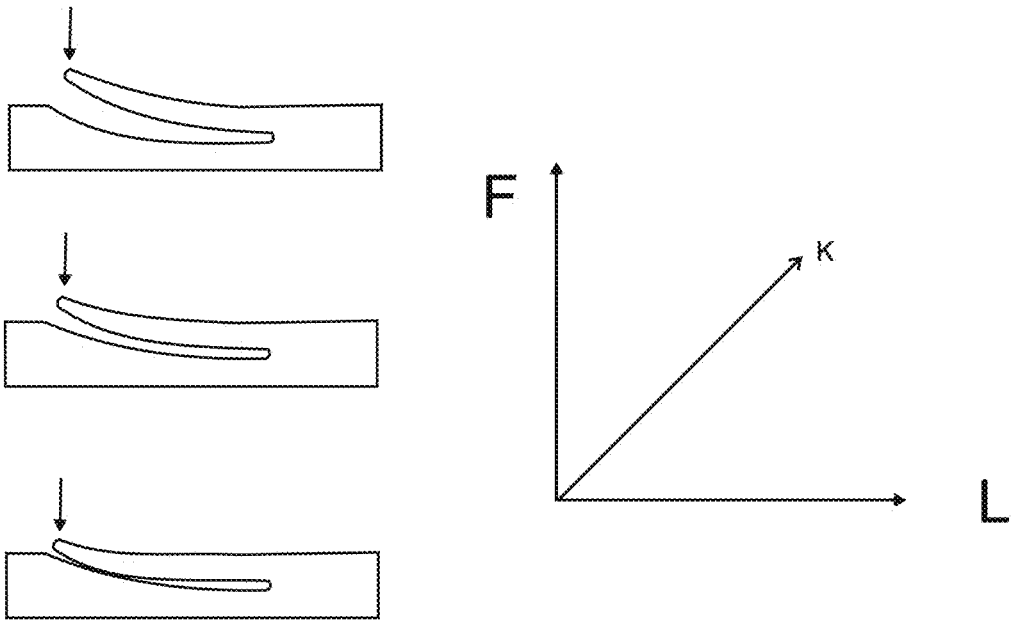
Figure 9A:
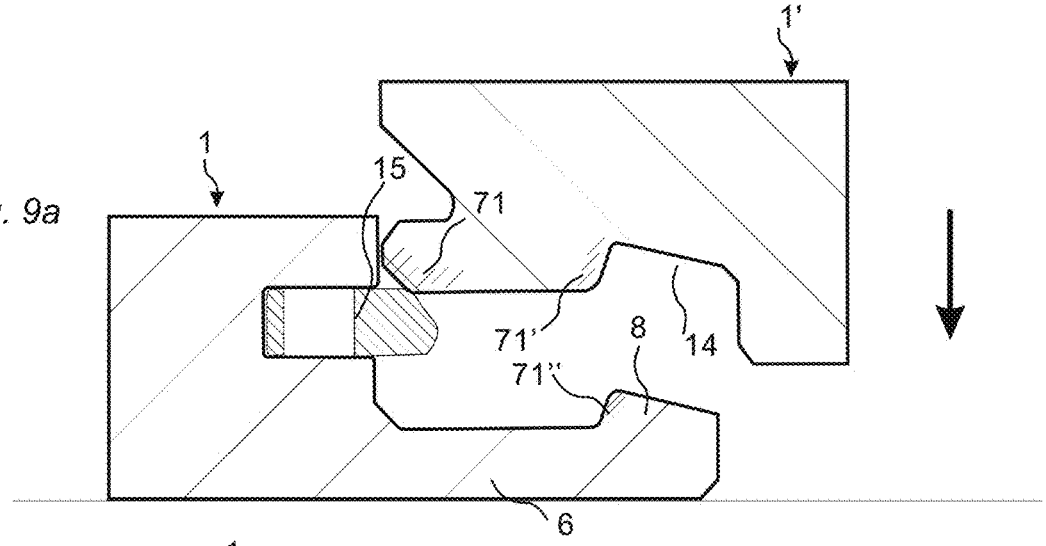
FIGS. 9*a-d* show installation with vertical folding or vertical locking according to one embodiment of the invention.
Figure 9B:
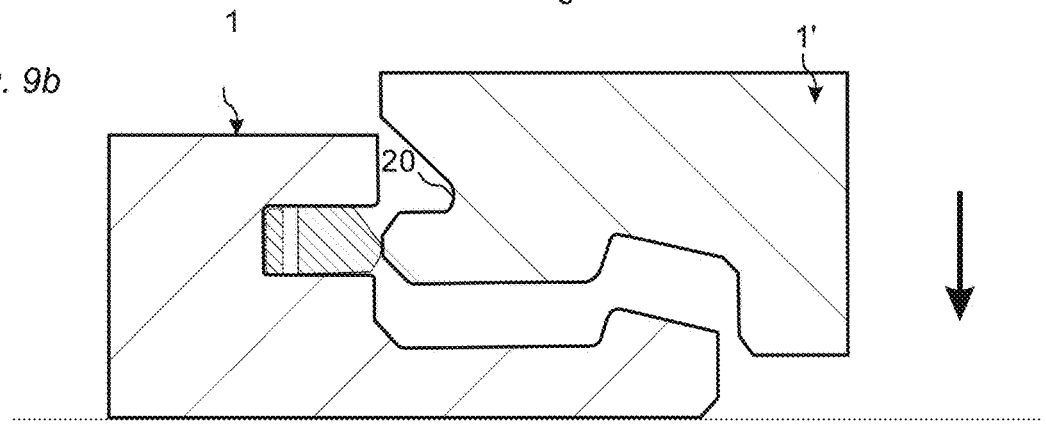
Figure 9C:
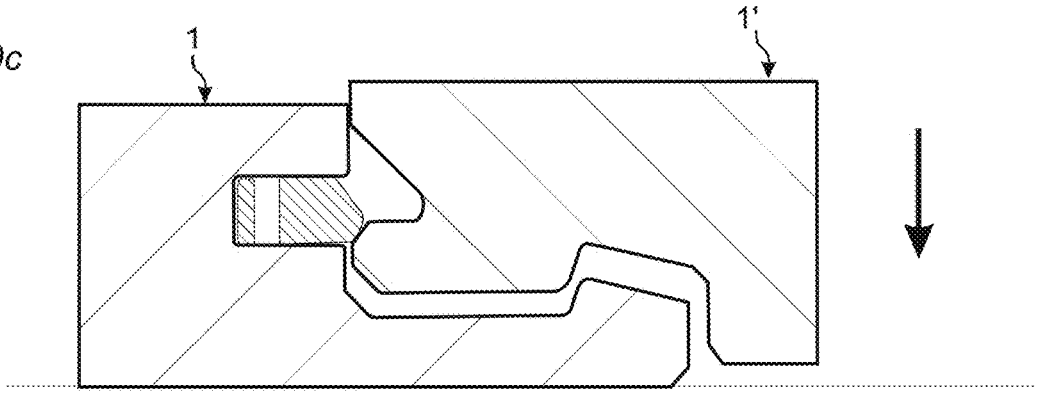
Figure 9D:
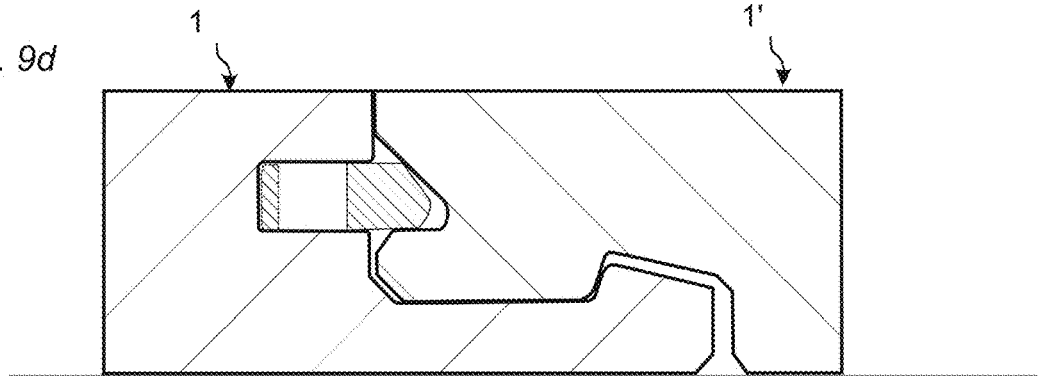
Figure 10A:
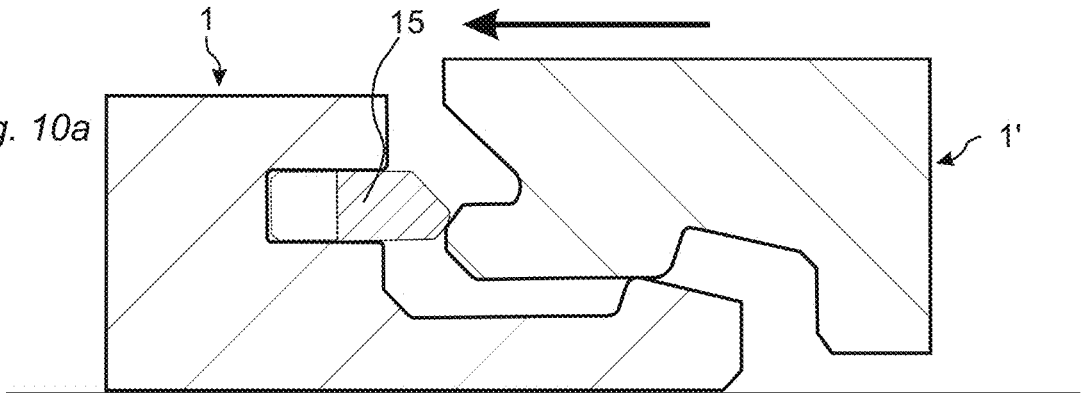
FIGS. 10*a-d* show installation with snapping according to one embodiment of the invention.
Figure 10B:
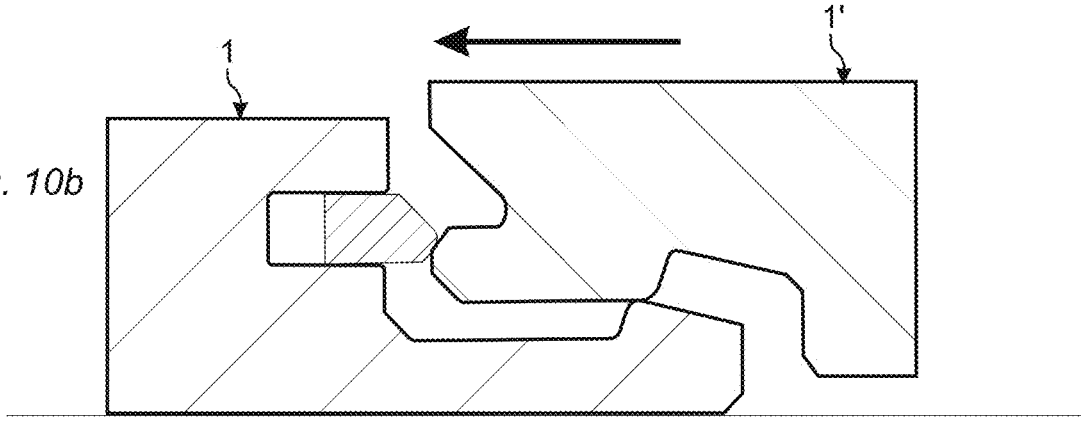
Figure 10C:
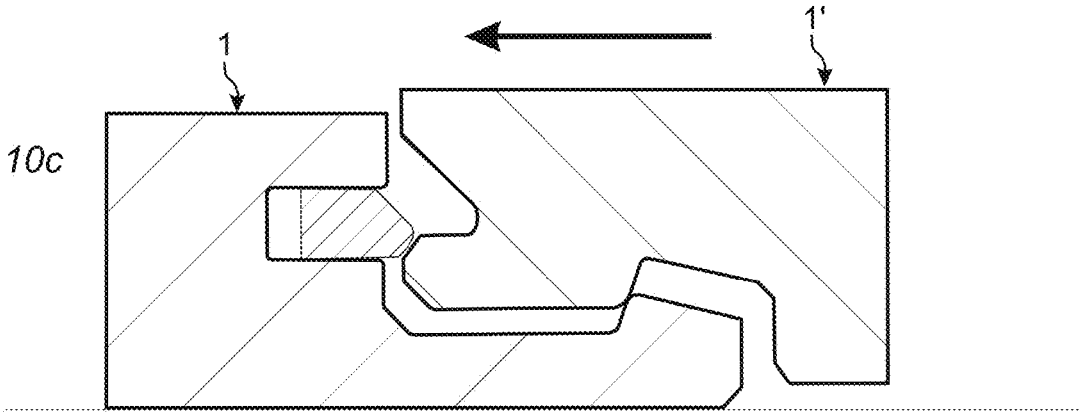
Figure 10D:
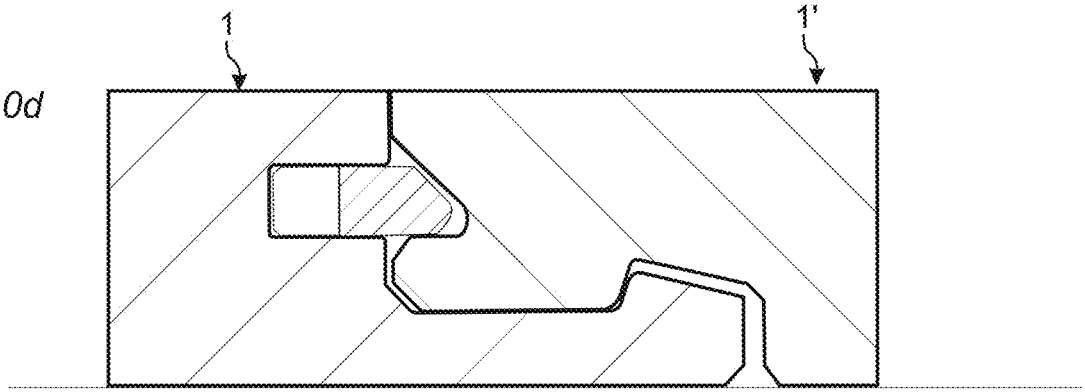
Figure 11A:
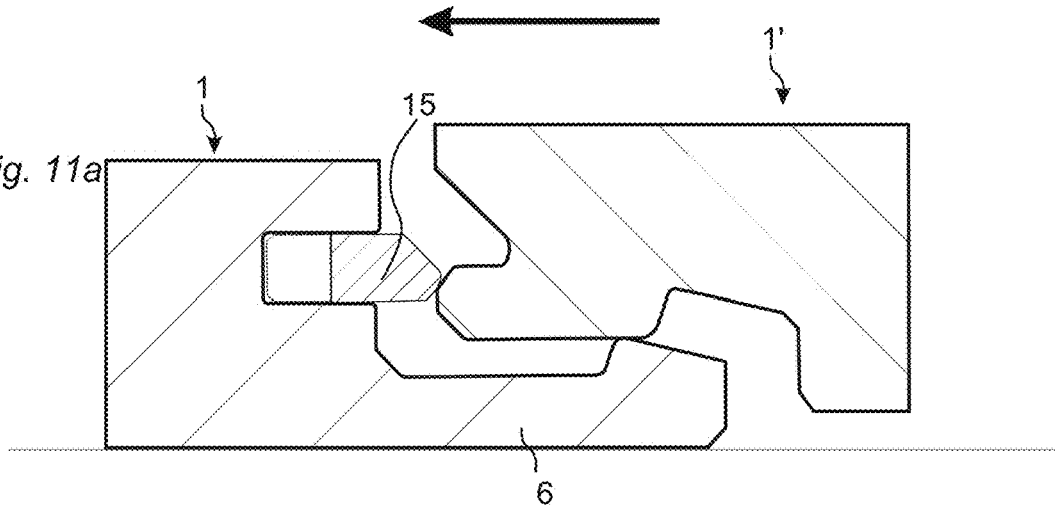
FIGS. 11*a-d* show an embodiment of installation with snapping facilitated by a flexible tongue and bending of a locking strip.
Figure 11B:
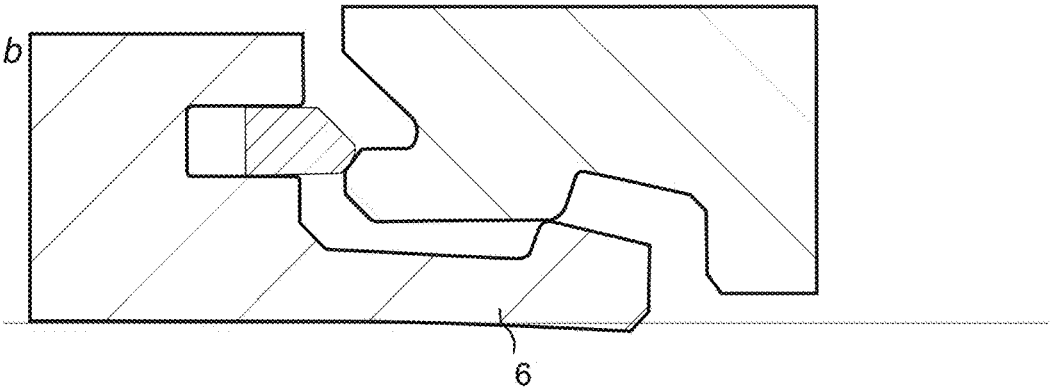
Figure 11C:
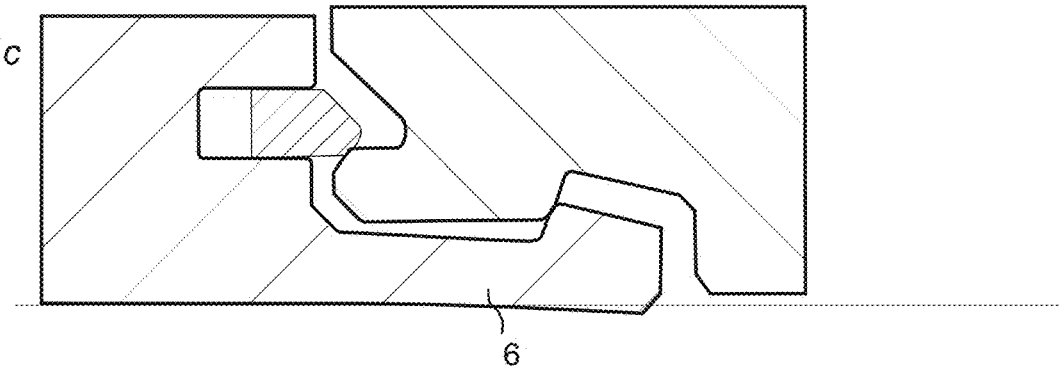
Figure 11D:
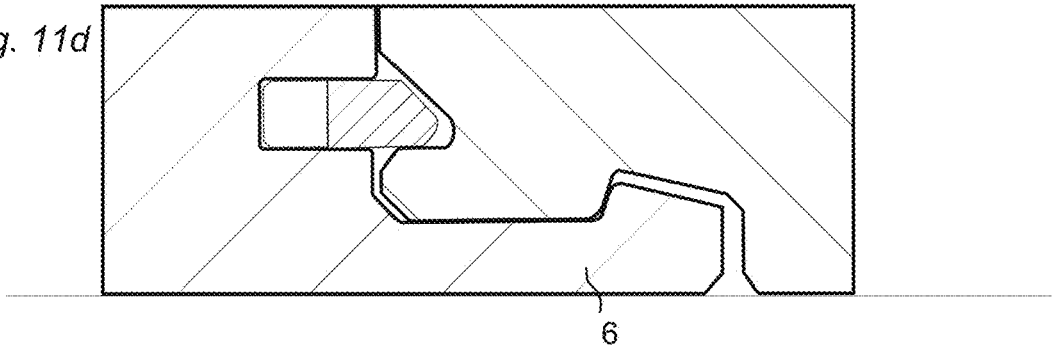

To facilitate the installation it is advantageous if the spring constant of the protruding part is as linear as possible. A linear spring constant results in a nice and smooth connection movement without suddenly or heavily increased displacement resistant. According to one embodiment, this is achieved by a bow shaped protrusion. FIG. 8*b* shows that a bow shaped protrusion results in an essentially constant moment arm, the force is during the whole course of connecting two panels at the tip of the protrusion, and an essentially linear spring constant. FIG. 8*a* shows that a straight protrusion results in that the moment arm is changed during the course; the force is spread out over a larger part of the length of the protrusion, resulting in an increased spring constant during the course. F is the displacement force and L is the displaced distance.

The preferred recess at the protrusion has the advantage that the protrusion is not destroyed if too much force is applied or the tongue is displaced too far. The protrusion is pushed into the recess and a cracking of the protrusion is avoided.

Figure 7A:
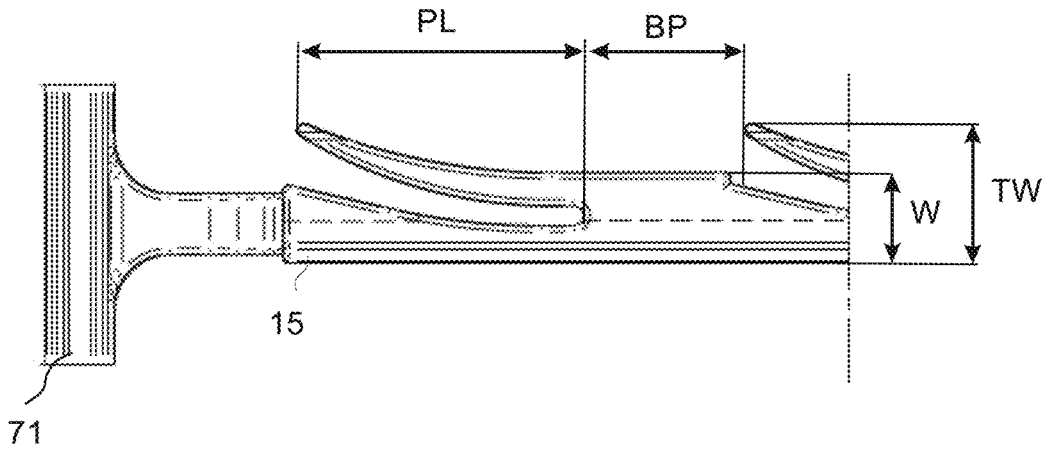
FIGS. 7*a-b* show the displaceable tongues in an embodiment according to the invention in a top view and a 3D view.
Figure 7B:
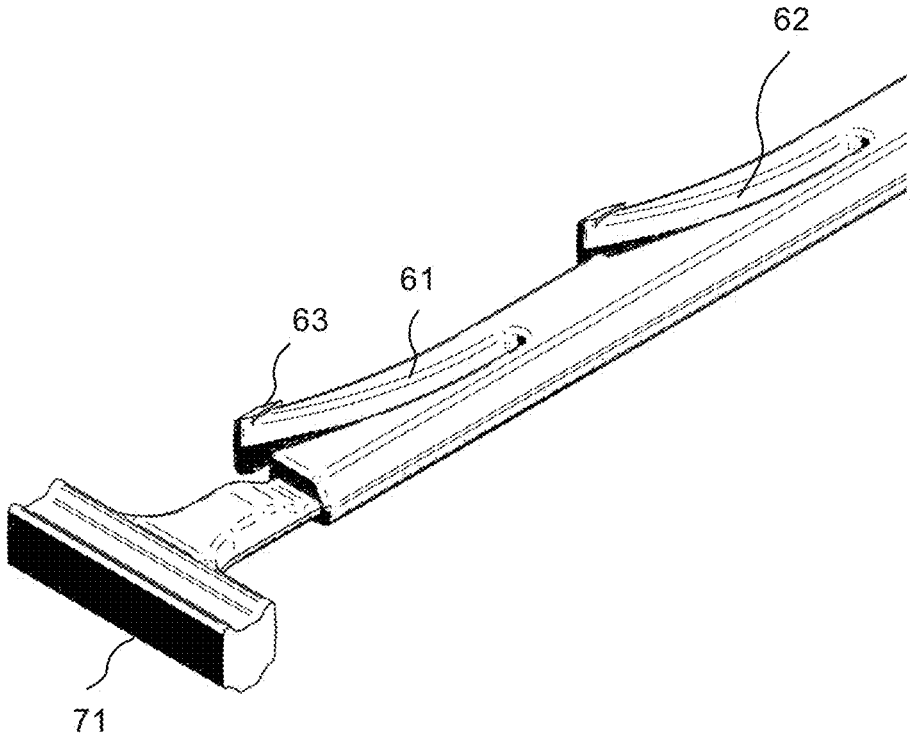

FIGS. 7*a*-*b* show two enlarged embodiments of a part of the tongue in a top view and in a 3D view. The figures show a casting gate 71 which is cut off before insertion into the displacement groove.

It is preferred that the length of the protrusion PL is larger than the total width TW of the tongue. The total width is the width of the tongue W plus the distance from the tongue body to the tip of the protrusion perpendicular to the length direction of the tongue. In the most preferred embodiment, PL is larger than 2*TW. It is also preferred that the recess is wider near the tip of the protrusion than near the bottom of the recess; as shown in FIG. 7*a*.

Preferably, the force to displace the tongue 1 mm is per 100 mm length of the tongue in the range of about 20 to about 30 N.

Preferably the length of the protrusion PL is in the range of about 10 mm to about 20 mm, the width W of the tongue is in the range of about 3 mm to about 6 mm and the total width TW of the tongue is in the range of about 5 mm to about 11 mm. The length of the body part BP between two protrusions, i.e. the distance from the root of one protrusion to the tip of an adjacent protrusion, is in the range of about 3 mm to about 10 mm. As a non-limiting example, for a width of a floor panel of about 200 mm, including the width of the locking system at adjacent edges, with a tongue length of about 180 mm, having 9 protrusions the protrusion length is about 15 mm, the length of the body part BP is about 5 mm, the width of the tongue W is about 5 mm and the total width TW is about 8 mm.

The tongues according to the embodiments of the invention are all possible to mould in one piece. It is further possible to cut the moulded tongue in shorter pieces which all have the same properties per length unit, provided that the number of protrusions is not too few. Another production method is extrusion combined with punching or cutting of the recess and the protrusions of the tongue.

FIGS. 9*a*-9*d* show a locking system, which allow vertical folding and vertical locking according to the main principles of the invention. In order to facilitate locking, the locking system comprises a friction reducing agent (71, 71', 71") such as wax, oil or similar chemicals at the edge of folding panel 1' and/or at the locking element 8 and/or at the locking grove 14. Preferably all flexible tongues shown in this application are provided with a friction reducing agent, e.g. wax or oil.

FIGS. 10*a*-10*d* show that a locking system, which allows vertical folding, also could be designed to be locked with horizontal snapping. In this embodiment the snapping is mainly facilitated by the flexible tongue (15). The locking system could be designed to be locked with a substantial horizontal displacement or with a combination of horizontal and vertical displacement, as shown in FIGS. 10*a*-*d*. The outer parts of the tongue 15 and the edge of the folding panel 1 could be designed with bevels and/or rounded parts that facilitate snapping FIGS. 11*a*-11*d* show that the snapping could also be combined with a flexible strip (6) that during snapping is bended downwards towards the sub floor.

Figure 12A:
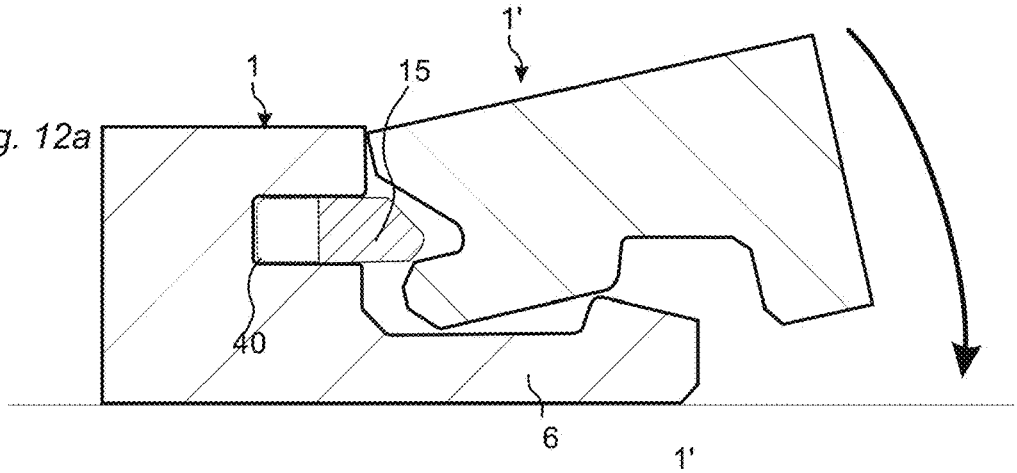
FIGS. 12*a-d* show an embodiment of installation and disconnection of panels with angling.
Figure 12B:
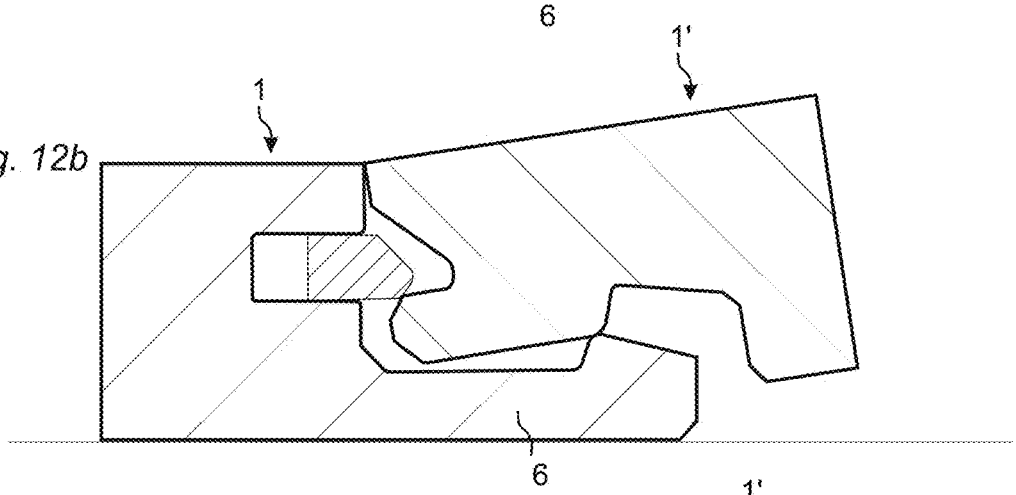
Figure 12C:
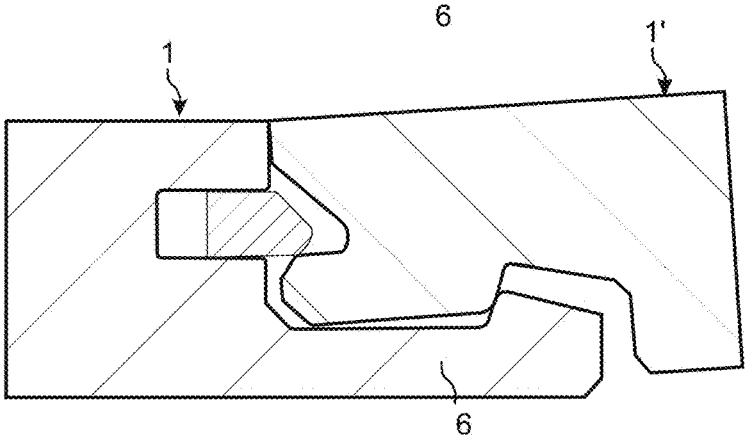
Figure 12D:
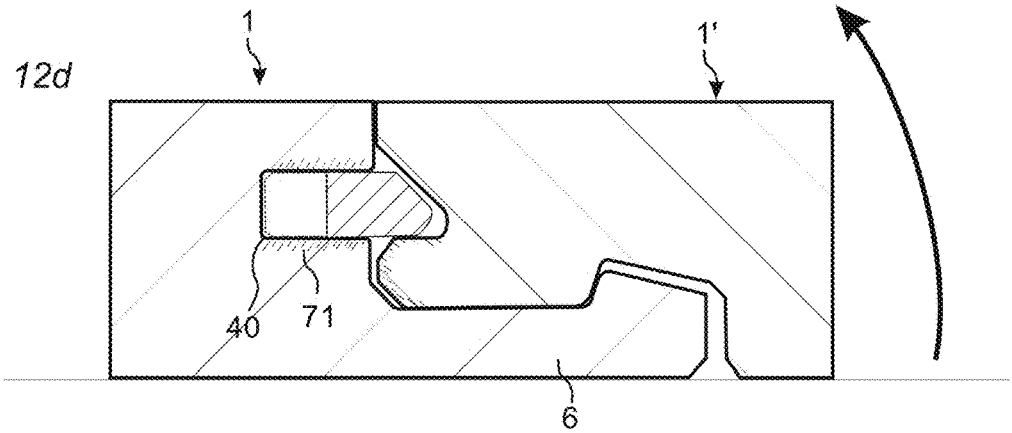

FIGS. 12*a*-12*d* show that the locking system also could be designed to allow locking with angling. FIG. 12*d* shows that the locking system also could be unlocked with angling. Wax and other types of friction reducing agents could also be applied in the displacement groove, the tongue groove or in the locking system and especially on surfaces that during locking are in contact with the flexible tongue. Such friction reducing agent will improve the locking and unlocking functions in all locking systems, for example shown in FIGS. 2*b*, 13*c*-*d*, 14*a*-*c*, 15*a*-*b* and 17*a*-*e* where a part of a tongue is flexible.

A locking system, which could be locked with vertical folding, vertical locking, angling and snapping, could have many different types of tongues, which are made of a separate material than the core of the panel, which tongues are connected to a panel edge and which tongues have at least one part that is flexible. Examples of embodiments of locking systems and separate tongues that allow such locking are shown in FIGS. 2*b*, 13*c*-*d*, 14*a*-*c*, 15*a*-*b* and 17*a*-*e*.

All types of flexible tongues, which for example have snap tabs, are bended in length direction, have flexible protrusions inside or outside a groove etc. could be used. According to the invention a locking system with a separate tongue which has at least one flexible part is provided and this locking system has locking means which allow vertical and horizontal locking with vertical folding, vertical locking snapping with or without a flexible strip and with angling. It could also be unlocked by angling. Such a locking system will offer several advantages during installation of floor panels. Of course locking systems could be designed such that one or several of the above mentioned locking function could be prevented. For example a locking element, which has a locking surface essentially perpendicular to the horizontal plane, will prevent disassembly with angling up of the panel. Such a locking system will however have a high strength in the horizontal direction.

Figure 13A:
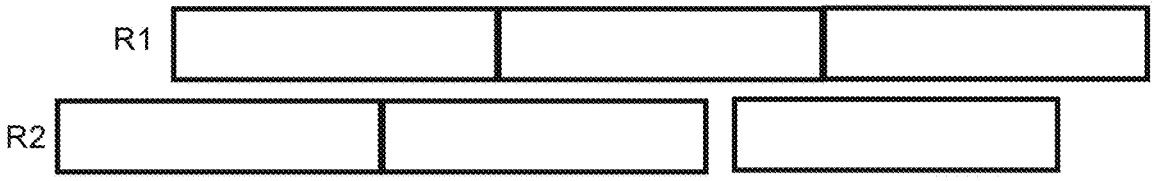
FIGS. 13*a-b* show an embodiment of an installation method.
Figure 13B:
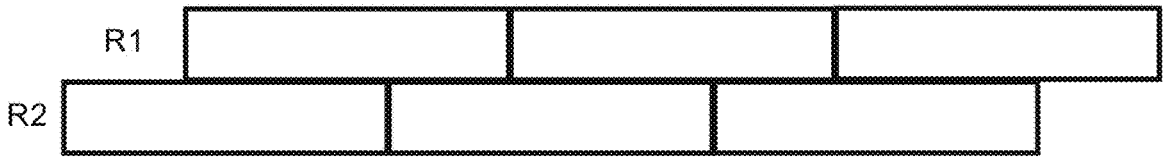

Vertical folding is in most cases the most convenient installation method. However, FIGS. 13*a* and 13*b* show an alternative installation method. The short sides of panels in a first row R1 are connected. The short sides of panels in a second row R2 are connected to each other by vertical locking or horizontal snapping where a part of a separate tongue, comprising a flexible part, is displaced during locking. Such a connecting method is extremely easy since the panels could be laid flat on the sub floor short edge against short edge and connected. They do not have to be angled or snapped together with a tapping block. The two adjacent rows R1 and R2 are then connected with angling.

The method comprises installation of floor panels comprising short edges with a mechanical locking system for locking the adjacent short edges vertically with a separate tongue comprising a flexible part and horizontally with a locking strip comprising a locking element and long sides with a mechanical locking system comprising a tongue, a groove a locking strip and a locking groove that allows vertical and horizontal locking by angling a) Installing a second row R2 of panels by connecting the short sides of the panels with vertical locking or horizontal snapping whereby the flexible part of the tongue is displaced b) Connecting the second row R2 to an installed and adjacent row R2 by angling.

Figure 13C:
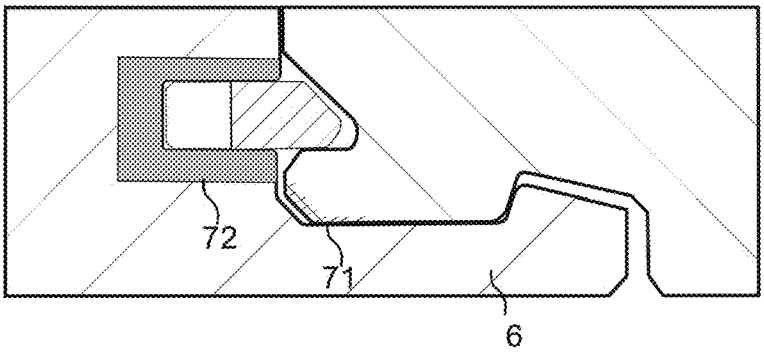
FIGS. 13*c-e* show embodiments with separate materials connected to the panel edge.
Figure 13D:
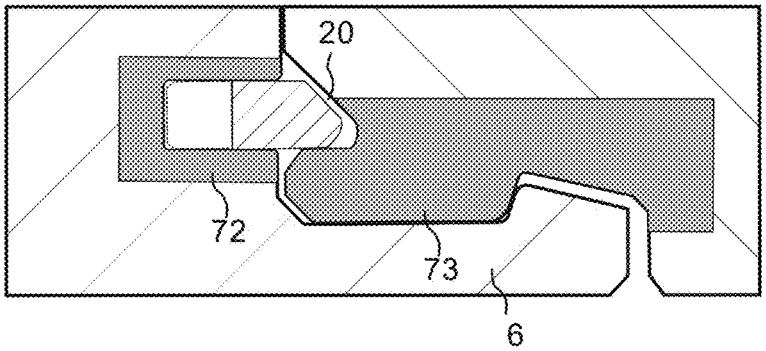
Figure 13E:
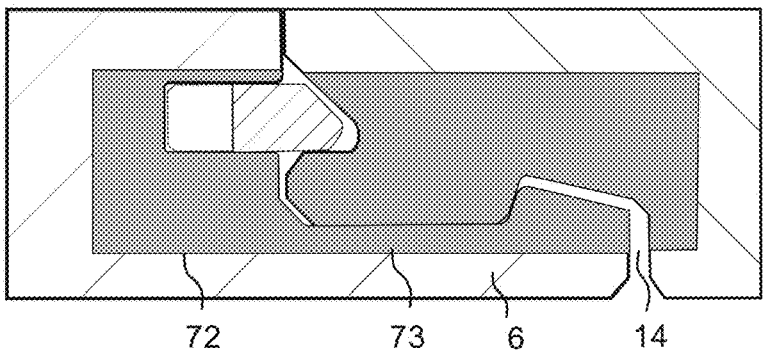

FIGS. 13*c*-13*e* show that separate materials 72-73 could be used to improve strength and locking functions. Such separate materials that could be connected as an edge portion in a for example a laminate or wood floor panel and they could preferably comprise hard wood, plywood, plastic materials, HDF, MDF and similar. Separate materials could be attached to one or both edges. They could form a part of the displacement groove, as shown in FIG. 13*c*, a part of the tongue groove 20, as shown in FIG. 13*d* or even at least a part of the locking strip 6 and the locking groove 14 as shown in FIG. 13*e*. Separate materials could be used in all locking systems with separate and partly flexible tongues. These principles could be used for example in locking systems shown in FIGS. 17*a*-17*e*.

Figure 14A:
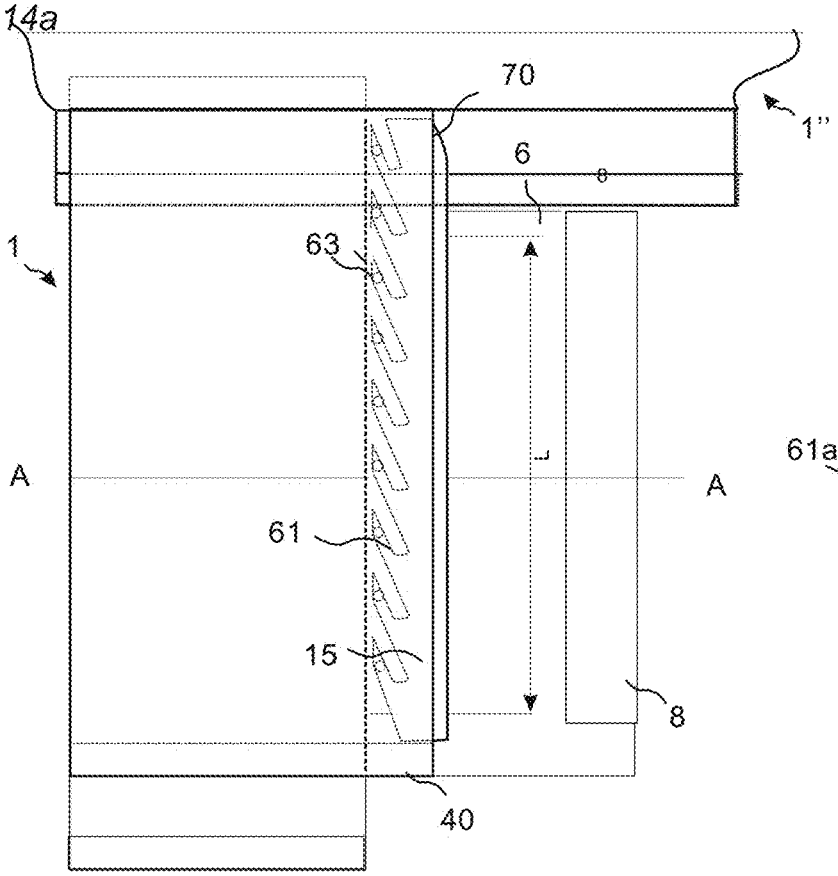
FIGS. 14*a-c* show embodiments according to the invention.
Figure 14B:
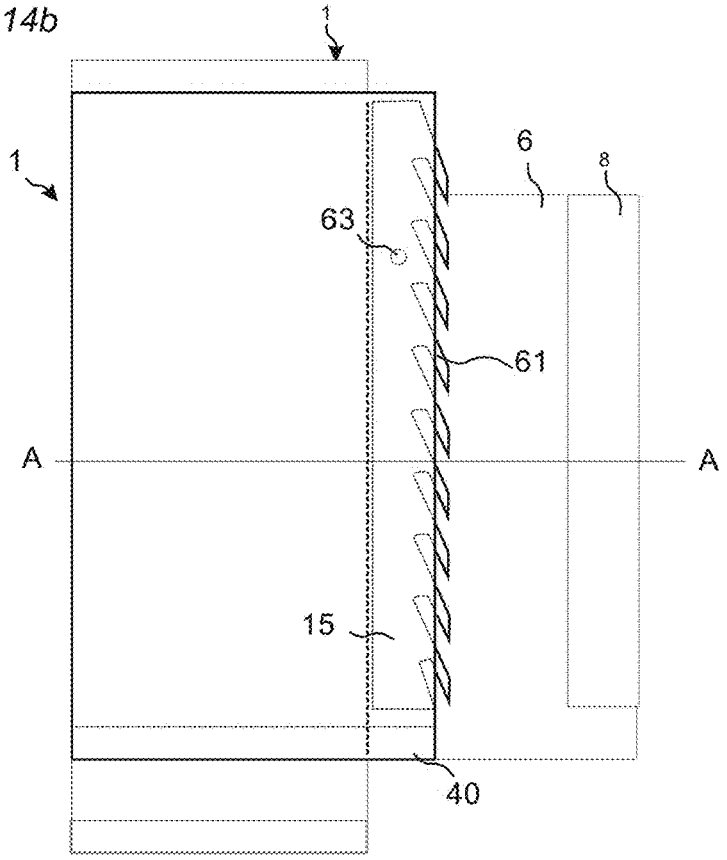

FIGS. 14*a* and 14*b* show that the protrusions 61 could be located inside or outside the displacement groove 40. The flexible protrusions, which are located outside the displacement groove, could be designed to cooperate with the tongue groove and to lock the panels vertically.

Figure 15A:
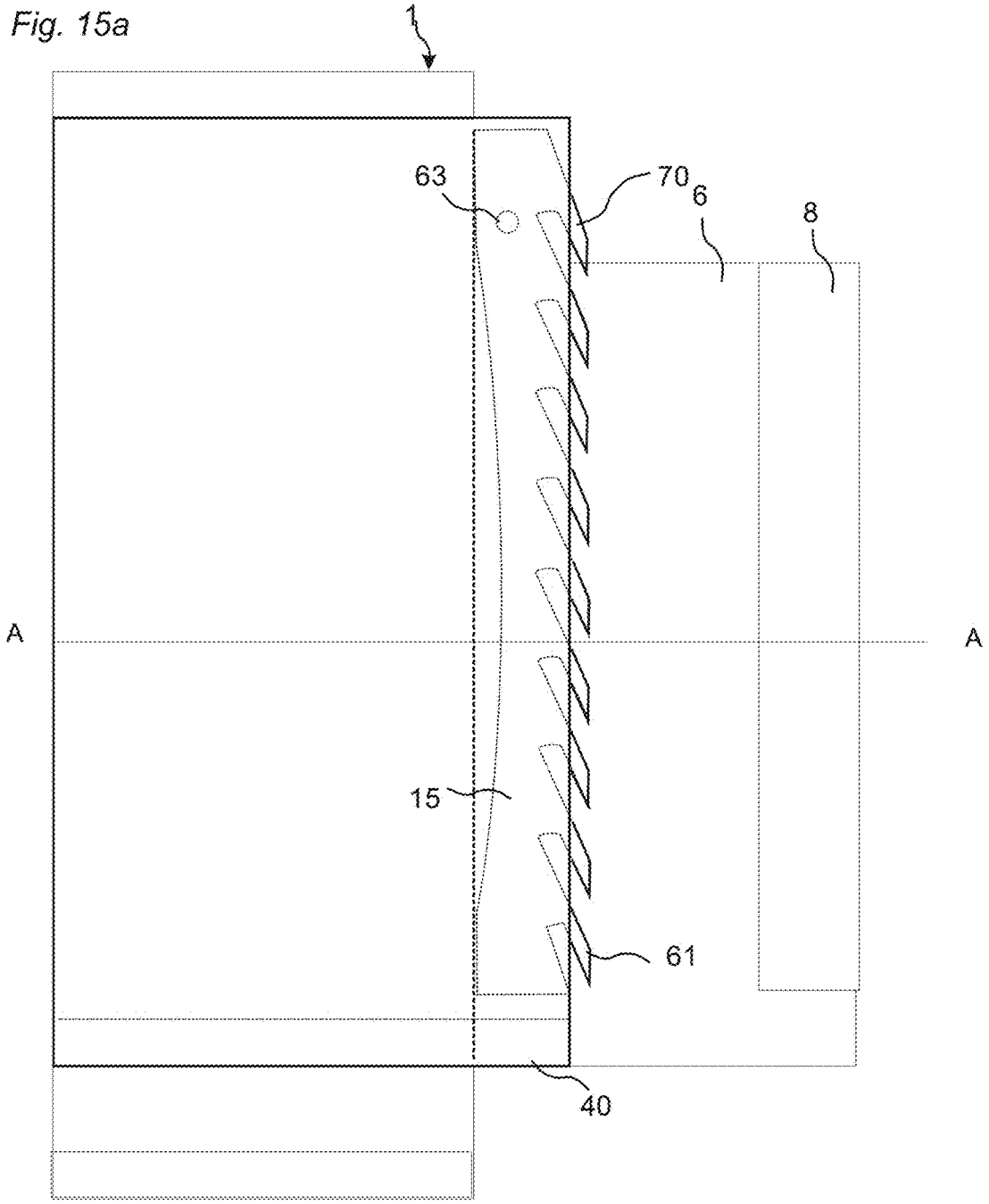
FIGS. 15*a-b* show embodiments according to the invention.

FIG. 15*a* shows an embodiment of the flexible tongue 15 with protrusions 61 partly outside the displacement groove and with a bow shaped inner part.

Figure 14C:
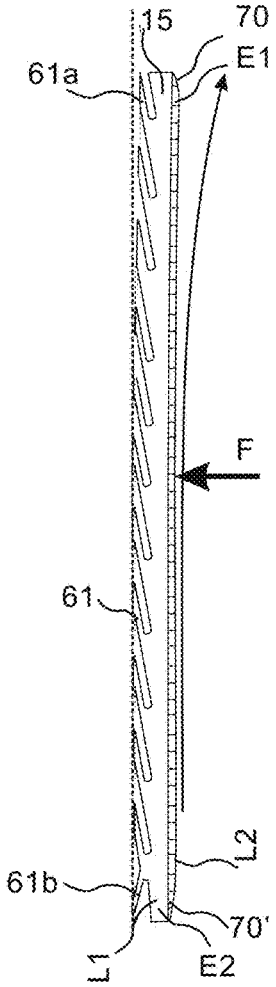

FIG. 14*c* shows that one short edge portion (E1) of the flexible tongue (15) which is located in the same direction as the direction as the protrusions, will bend out (provided that the friction connection do not prevent such bending) if a force F is pressed against the tongue when it is in the displacement groove with the protrusions inside the groove. Therefore it is preferred that in this embodiment, protrusions should be directed towards the part of the panel where the folding starts, as shown in FIG. 14*a*. Such an embodiment offers the advantage that the flexible tongue will not snap out during the final part of the folding. It is preferred that the flexible tongue has at least one rounded or beveled end portion (70). Such a portion could be integrated in a moulded tongue. It could also be for example a punched or cut part in a tongue, which is extruded. In this embodiment there are protrusions 61*a* and 61*b* at the edge portions of the tongue and these extrusions extend in different directions away from each other. The tongue has also two short edge portions E1 and E1 which are formed such that they do not extend outside the displacement grove as much as the middle part of the tongue. Such an embodiment will facilitate installation. The shape of the protrusions and the short edge portions could be used separately or in combination.

Figure 15B:
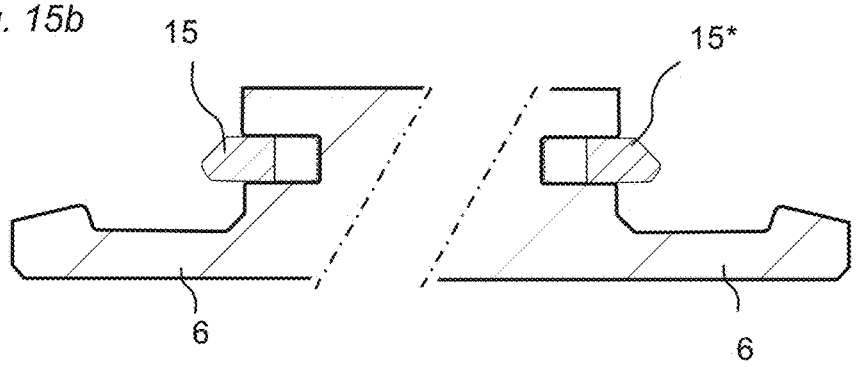

FIG. 15*b* shows an embodiment with flexible tongues 15, 15' on two opposite edges of the same panel. This is useful in advanced installations. All embodiments of separate tongues shown in this application could be used.

Figure 16A:
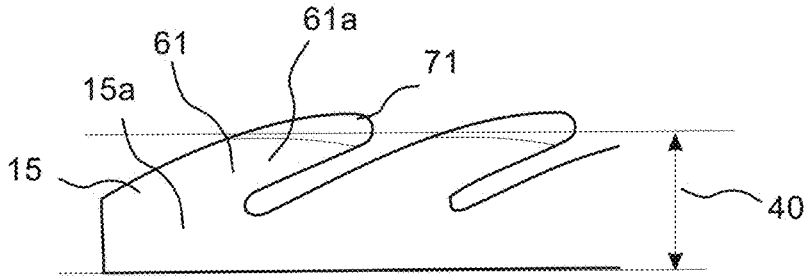
FIGS. 16*a-e* show embodiments according to the third object of the invention.
Figure 16B:
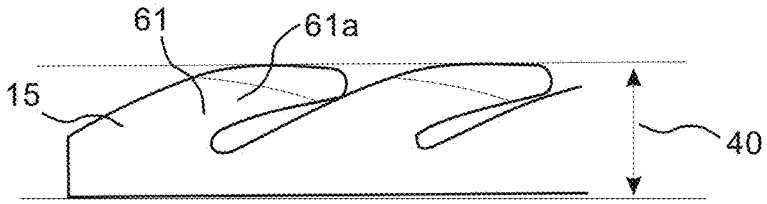
Figure 16C:
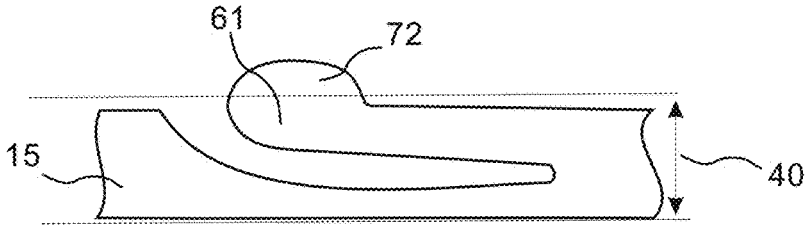

FIGS. 16*a*-16*e* show embodiments of a flexible tongue 15 with protrusions. FIG. 16*a* shows protrusions 61 with beveled or rounder tips (71). FIG. 16*b* shows the protrusions in a compressed position when they are pressed into the displacement groove 40. FIG. 16*c* shows round shapes 72 at the outer part of the protrusions, which facilitates installations with vertical folding from both long edges.

Figure 16D:
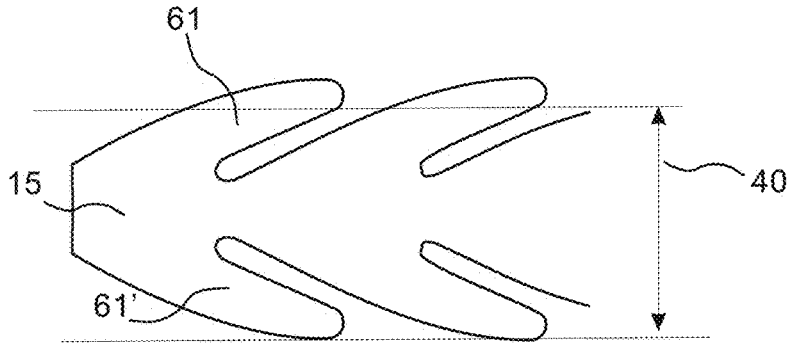
Figure 16E:
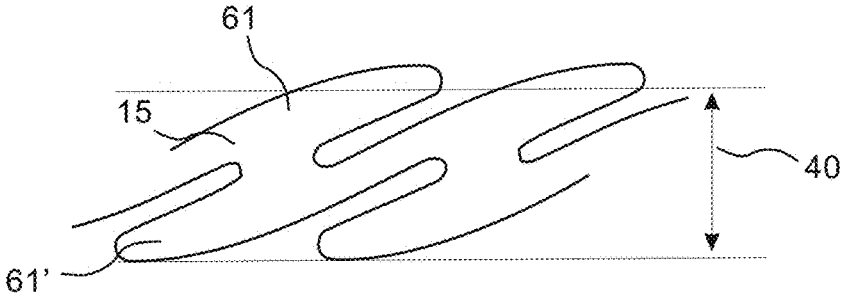

FIGS. 16*d* and 16*e* show embodiments with double protrusions 16, 16' inside and outside the displacement groove 40. All embodiments could be combined. For example a tongue with double protrusions as in FIGS. 16*d* and 16*e* could have rounder outer parts 72 as in FIG. 16*c*.

Figure 16F:
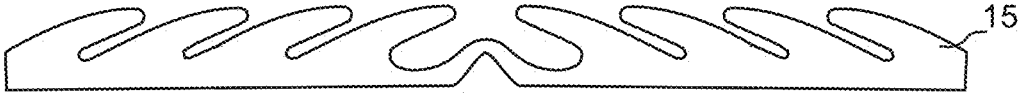
FIGS. 16*f-g* show embodiments of the tongue according to the invention.
Figure 16G:
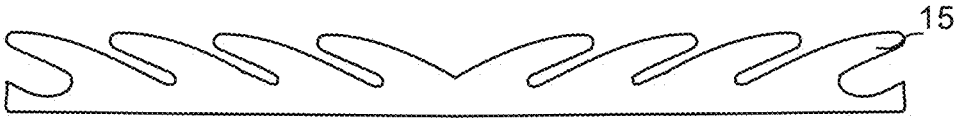
Figure 16H:
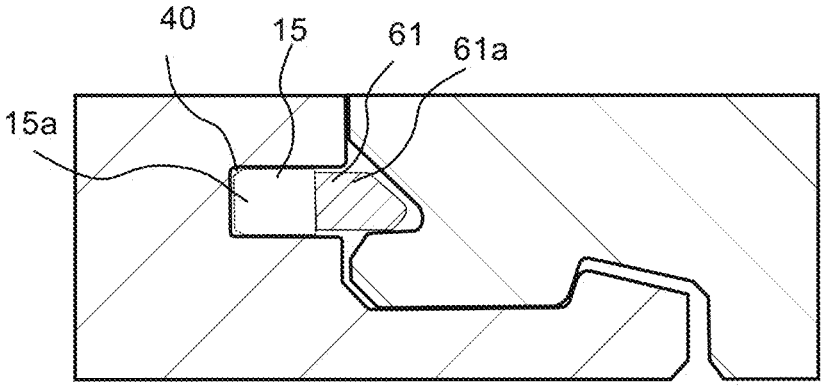
FIGS. 16*h-i* show embodiments of the invention.

FIGS. 16*h* and 16*a*-*b* show that the flexible tongue 15 could have a body 15*a* which is slightly thicker than the part of the part 61*a* of the protrusion 61 which is displaceable in the displacement groove 40 during locking. The play between the displacement grove and the protrusion reduces the friction and facilitates a reliable displacement of the protrusion 61. It is preferred that protrusions and flexible parts are such that the parts of the tongue which lock in the tongue groove exert a pressure force in locked position. An example is a tongue, which comprise flexible parts, which after 100 hours of compression, corresponding to the compression during vertical folding, could spring back to a position, which is at least 90% of their initial position.

FIGS. 16*f* and 16*g* show embodiments of the tongue, which are symmetric in a vertical plane perpendicular to the edge of the floor panel. These tongues have the same properties for both folding directions. The tongue in FIG. 16*g* with protrusions extending outwards at both ends of the tongue also has the advantage of support at the outer most edge of the tongue. In another preferred embodiment of a tongue with protrusions only in one direction, the tongue is symmetric in a horizontal plane, which gives the advantage that it is possible to turn the tongue upside down, resulting in the same properties for both folding directions.

Figure 16I:
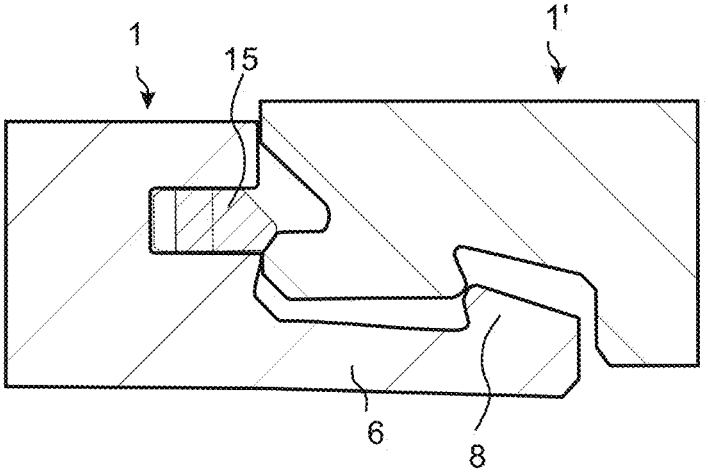

A locking surface of a locking element 8 at a locking strip 6 could be made with different angles, bevels and radius. The locking surface of the locking element 8 may e.g. extend inwardly towards the upper edge of the panel, as shown in FIG. 16*i*. The vertical locking could in such an embodiment consist of a flexible tongue 15 and a locking element 8 on a locking strip 6.

Figure 17A:
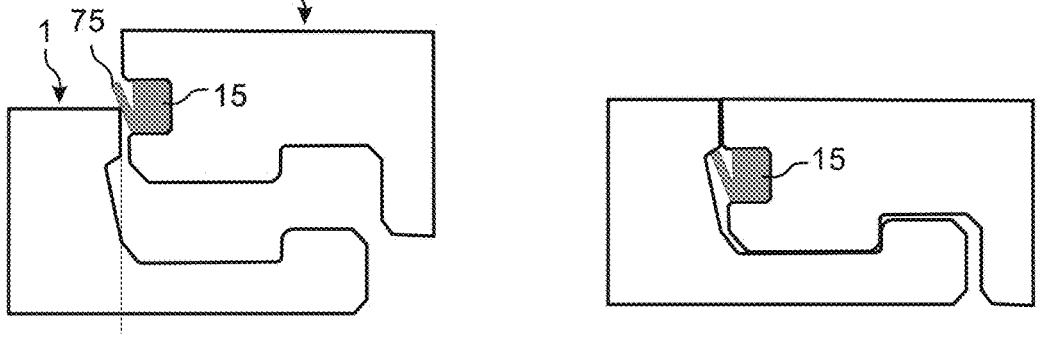
FIGS. 17*a-c* show embodiments of locking systems which could be applied in the fourth and fifth object of the invention.

FIG. 17*a* shows a flexible tongue 15 with flexible tab 75 extending upwards. The flexible tongue is connected to the folding panel 1.

Figure 17B:
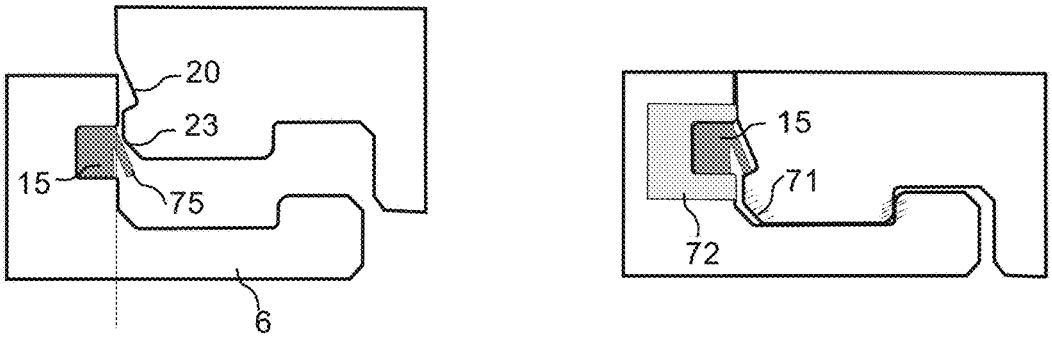

FIG. 17*b* shows a flexible tongue 15 with flexible tab 75 extending downwards. The flexible tongue is connected to the edge, which has a locking strip 6 extending from the edge. This embodiment is an improvement of the locking system shown in FIG. 17*a* since the flexible tab is not displaced by a sharp panel edge. The folding panel could be formed with a sliding surface 23, which facilitates the displacement of the snap tab 75. The snap tab could be designed with a pre-tension, which presses the folding panel downwards in locked position. The tongue with the flexible tab 75 could be combined with a bow shaped form or protrusions according to the main principles of the invention.

Figure 17C:
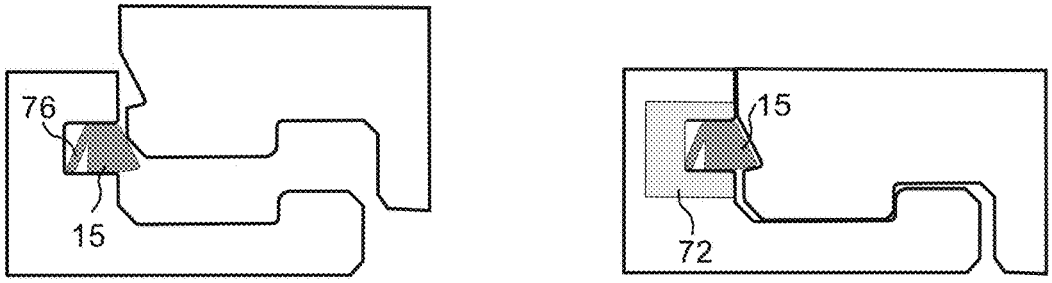

FIG. 17*c* shows that a flexible tab 75 could be located inside a displacement groove. It could be directed upwards or downwards and a separate tongue could have flexible tabs inside and/or outside a displacement groove.

Figure 17D:
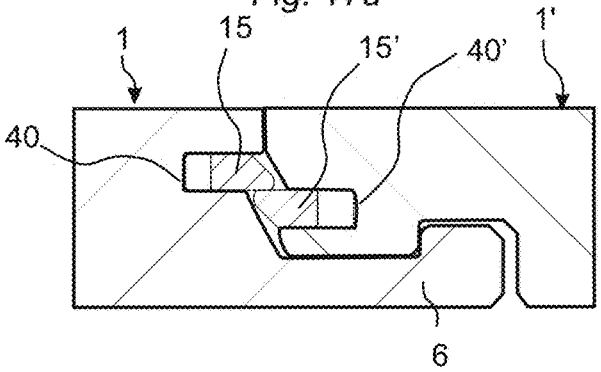
FIGS. 17*d-e* show embodiments of the invention.
Figure 17E:
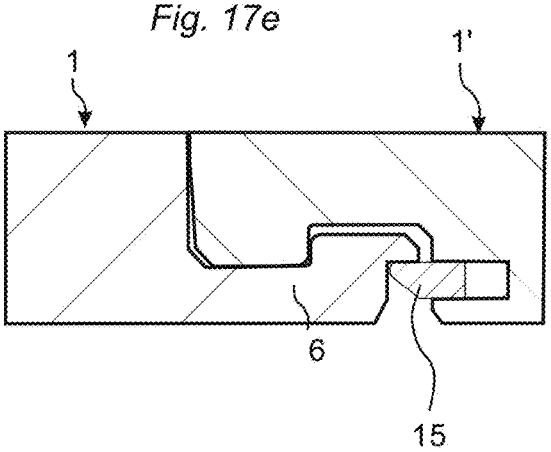

FIG. 17*d* shows an embodiment with two displaceable tongues 15, 15' over and under each other. FIG. 17*e* shows that the flexible tongue could be locked against a part of the locking strip 6. All tongues shown in this application could be used in such locking systems.

A flexible tongue with protrusion could be used to lock very thin floor panels for example about 6 mm and even thinner. Even with a vertical thickness of a flexible tongue of about 1 mm a strong vertical locking could be obtained. Protrusions could be made extremely small. They could for example extent only about 1 mm or even less into the tongue groove and there could be more than 1 protrusion per 10 mm of the tongue length.

The invention claimed is:

1. A building panel having an edge portion provided with a groove, in which a tongue formed as a separate part is received, wherein the tongue comprises a tongue body and two or more protrusions at a first long edge of the tongue body, the tongue comprises a space between each protrusion and the tongue body, wherein each protrusion is bendable into the respective space, and in the groove, wherein the tongue body is displaceable in the groove, wherein the protrusions each include a concave surface facing away from the tongue body.

2. The building panel as claimed in claim 1, wherein the tongue has a second long edge, wherein the second long edge extends outside the groove.

3. The building panel as claimed in claim 2, wherein the second long edge is essentially straight over substantially the whole length of the tongue.

4. The building panel as claimed in claim 3, wherein the second long edge of the tongue is continuous.

5. The building panel as claimed in claim 2, wherein the groove is made of a different material than a core of the building panel.

6. A building panel as claimed in claim 1, wherein the tongue presents a sliding surface, wherein the sliding surface is inclined relative to a main plane of the building panel.

7. A building panel as claimed in claim 1, wherein the tongue is of an elongated shape and made of moulded plastic.

8. The building panel as claimed in claim 1, wherein the protrusions are configured to extend into the groove of the building panel.

9. The building panel as claimed in claim 1, wherein the space includes a protrusion groove having a whole length substantially equal to a whole length a respective protrusion.

10. The building panel as claimed in claim 1, wherein an upper surface and a lower surface of the tongue are displacement surfaces.

11. The building panel as claimed in claim 10, wherein the upper surface and/or the lower surface has/have a bevelled edge, presenting a sliding surface and an inclined locking surface, respectively.

12. The building panel as claimed in claim 1, wherein a vertical protrusion is arranged at an upper side and/or at a lower side of at least one of the protrusions.

13. The building panel as claimed in claim 12, wherein the vertical protrusion is arranged at a distal end of the at least one of the protrusions.

14. The building panel as claimed in claim 1, wherein tongue is made of polypropylene or polyoxymethylene, and is reinforced with fibres.

15. The building panel as claimed in claim 14, wherein the fibres are glass fibres.

* * * * *